US007357765B1

(12) United States Patent
Watson et al.

(10) Patent No.: US 7,357,765 B1
(45) Date of Patent: Apr. 15, 2008

(54) LUMBAR EXTENSION DEVICE

(76) Inventors: Hughie B. Watson, 6100 Britmoore Rd. Bldg. S, Houston, TX (US) 77041; Stuart A. Campbell, 6100 Britmoore Rd. Bldg. S, Houston, TX (US) 77041

( * ) Notice: Subject to any disclaimer, the term of this patent is extended or adjusted under 35 U.S.C. 154(b) by 0 days.

(21) Appl. No.: 11/489,125

(22) Filed: Jul. 19, 2006

(51) Int. Cl.
*A63B 26/00* (2006.01)

(52) U.S. Cl. ..... 482/142; 482/92

(58) Field of Classification Search ..... 482/142, 482/92–100
See application file for complete search history.

(56) References Cited

U.S. PATENT DOCUMENTS 4,462,252 A 7/1984 Smidt et al. ..... 73/379
4,836,536 A 6/1989 Jones ..... 272/134
5,171,200 A * 12/1992 Jones ..... 482/134
5,928,112 A * 7/1999 Jones et al. ..... 482/8
5,971,902 A 10/1999 Robertson et al. ..... 482/142
6,746,384 B2 6/2004 Cole et al. ..... 482/130
7,052,446 B2 * 5/2006 Morris et al. ..... 482/100

* cited by examiner

*Primary Examiner*—Lori Amerson
(74) *Attorney, Agent, or Firm*—Richard L. Moseley

(57) ABSTRACT

A lumbar extension machine is disclosed including a seat with an upright rotatable back member securable to a variable resistance module or statically secured to a load cell module. A lower body system is provide to optimize the exercise of the lower back by preventing movement and work by the hips and thighs. A pelvic restraint pad is located adjacent the seat and the seat is adjustable at the pad to insure that the iliac crest is properly located at the pad. An adjustable foot rest is provided to align the thigh with the seat angle after the seat height has been properly adjusted. The load cell provides strength testing to allow the clinician to determine relative strength and establish treatment parameters and monitor treatment progress and validate and quantify treatment results.

11 Claims, 26 Drawing Sheets

130

LUMBAR EXTENSION DEVICE

BACKGROUND OF THE INVENTION

1. Field of the Invention

The present invention relates to methods and apparatus for the exercising and/or testing of muscles of the human body. More particularly, the invention relates to an exercise machine which has the ability to isolate and focus specifically on the lumbar extensor muscles and lumbar musculoskeletal system and apply selected and appropriate exercise intended to produce a specific, desired result. More particularly, the invention relates to a device which can also be used to test relative muscular strength/torque.

2. Related Information

There are numerous and various types of problems and conditions which are typically referred to as "low back pain." There can be numerous and various causes and contributing factors which often result in chronic low back pain. Although there can be numerous causes and contributing factors which result in varied diagnostic findings, there is often at least one common symptom in most chronic low back pain situations. Below normal strength levels are a major factor in most instances of low back pain, especially if the incident develops into a chronic situation. Regardless if below normal strength levels were a cause or exacerbation, one positive step that can be taken to provide treatment and rehabilitation is to introduce properly applied therapeutic exercise. In most instances, low back pain produces a decrease in regular, meaningful physical activity. As muscular strength decreases due to disuse atrophy, the lumbar musculoskeletal system becomes weak and compromised which typically leads to pain and dysfunction. This cycle of deterioration becomes self perpetuating and often results in the low back pain sufferer becoming a candidate for surgery. Research and clinical studies indicate that many of the common forms of "low back pain" can be successfully treated and rehabilitated by the proper application of therapeutic exercise.

The present invention provides the apparatus and the basis to develop a treatment and rehabilitation program intended specifically to increase the strength of the lumbar musculature. The basic principal is to introduce an overload stimulus which, when properly applied in proper amounts and at proper intervals and for an appropriate period of time, duration, will produce a specific, desired response. The specific desired response is an increase in muscular strength. Research and clinical studies have established that an increase in strength is typically accompanied by other desired improvements: a decrease in perceived pain; restored structural integrity; improved functional ability and enhanced quality of life. The present invention has the ability to introduce or apply an effective overload stimulus by inducing fatigue. Fatigue results from physical exertion or work. In the rehabilitation process, the magnitude of the overload stimulus, work, is increased from session to session. An increase can be either an increase in resistance or an increase in the number of repetitions performed. Proper increases in work, overload stimulus, at proper intervals will produce an increase in the ability to perform that work. This assumes, of course, that other relevant considerations, such as overall health and nutrition are also positive and proper. In a rehabilitation environment, physical exertion, kinetic activity, can be referred to as prescribed therapeutic exercise. The present invention comprises various features and functions which allow the controlled application of therapeutic exercise. An important aspect of any treatment and rehabilitation apparatus or program is the ability to test. Test information is useful in determining current/existing strength levels, establishing treatment and rehabilitation parameters, monitoring treatment progress and quantifying treatment and rehabilitation results.

OBJECTS OF THE INVENTION

In light of the above it is an object of the present invention to incorporate some new and unique features and functions and some previously established features and functions into a device which collectively provide a broad range of efficacious options and alternatives for the treatment and rehabilitation of many common forms of spinal pathology.

A further object of the present invention is to provide novel and improved methods and apparatus for the application of appropriate exercise to specific muscles and/or a specific musculoskeletal system.

A further object of the present invention is to provide novel and improved methods and apparatus for testing of specific muscles and/or a specific musculoskeletal system.

A further object of the present invention is to provide novel and improved methods and apparatus for exercising specific muscles and/or muscle groups incorporating a novel and improved mechanism for providing resistance to muscle exertion during exercise.

A further object of the present invention is to provide novel and improved methods and apparatus for restraining the lower body to remove and/or limit lower body influence and participation in exercise and testing of the targeted muscles and/or muscle groups.

A further object of the present invention is to provide novel and improved methods and apparatus which positively affect the size, weight, complexity and operational efficiency of this device of the present invention.

SUMMARY OF THE INVENTION

To accomplish the above objects the present invention includes a device or apparatus having a seat assembly which effectively restrains the lower body and properly positions the pelvis against a pelvic restraint pad. Operatively attached to the seat assembly is a movement arm which pivots around an axis to allow effective exercising and/or testing of specific, targeted muscles and/or muscle groups. The movement arm is operatively connected to a variable resistance mechanism which provides selected, appropriate resistance against movement and muscular exertion by the subject/exerciser. Included in one preferred embodiment is the ability to test relative muscular strength/torque. Thus the lumbar extension machine of the present invention comprises:

(a) a seat assembly comprising;

(i) a seat frame (ii) a seat hingedly secured at the front to said seat frame;

(iii) a pelvic restraint pad secured to said seat assembly;

(iv) a pair of rotating cams rigidly connected by a rod and mounted underneath and transverse said seat adjacent said pelvic restraint pad such that when said rod is rotated the cams move the rear of said seat upward or downward;

(b) a movement arm assembly rotatably secured to said seat assembly, said movement arm assembly having an axis of rotation (c) a variable resistance mechanism securable to said movement arm assembly through its axis of rotation, said variable resistance module comprising a free weight attached to an adjustable length lever arm by a series of pulleys and pulley belts one of said pulleys being rigidly attached to said rotatable back member through its axis of rotation;

(c) a load cell module statically securable to said movement arm assembly through its axis of rotation;

(d) a proximity sensor module mounted adjacent said movement arm assembly to count the repetitions of passage;

(e) a pair of handlebars extending from the upper end of said movement arm assembly;

(f) an adjustable lower body restraint system mounted on said seat assembly comprising;

(i) a height adjustable foot rest connected to said seat frame, and (ii) a pair of adjustable shin pad restraints connected to said seat frame;

(g) a pivoting resistance pad at the upper end of said movement arm assembly; and (h) a pelvic restraint pad secured on said back member near said seat.

DETAILED DESCRIPTION OF THE PREFERRED EMBODIMENT

Figure 1:
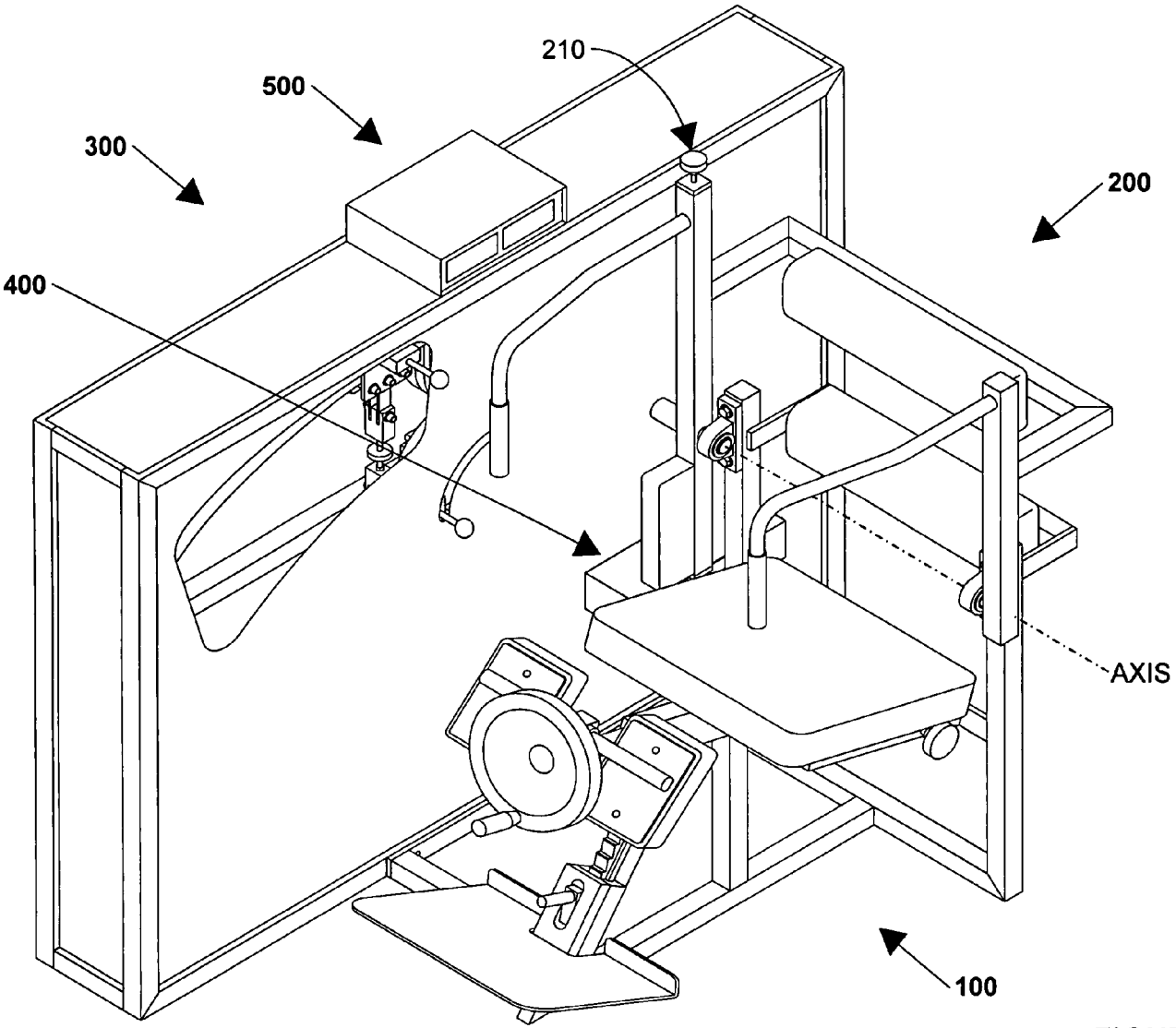
FIG. 1 is an isometric view of the device incorporating one preferred embodiment of the present invention for testing and exercising the muscles of the lumbar spine.
Figure 2:
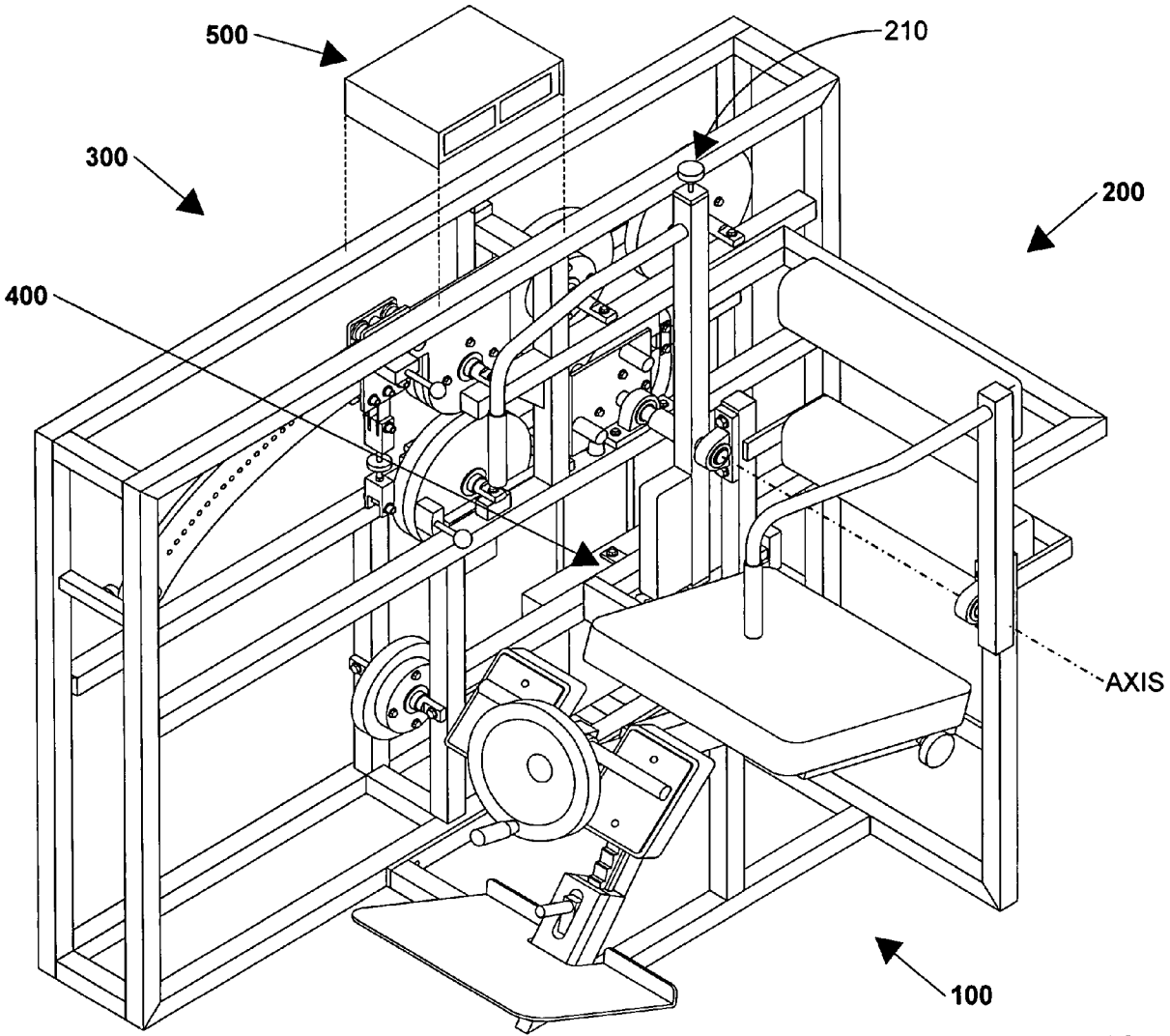
FIG. 2 is an isometric view of the device of the present invention showing major elements and configurations, however, some parts omitted for clarity.
Figure 3:
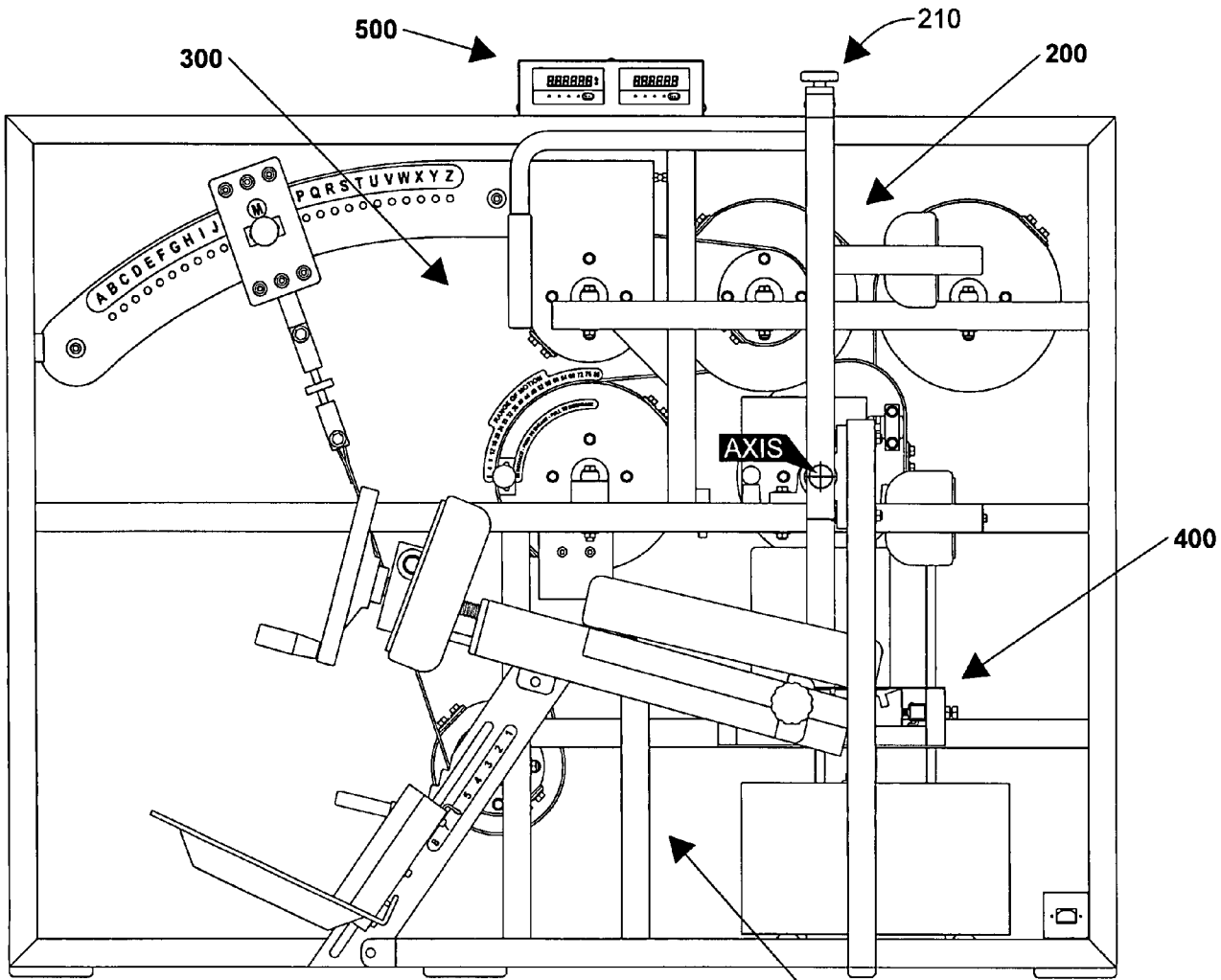
FIG. 3 is a side elevational view of the device of the present invention showing major elements and configurations, however, some parts omitted for clarity.
Figure 4:
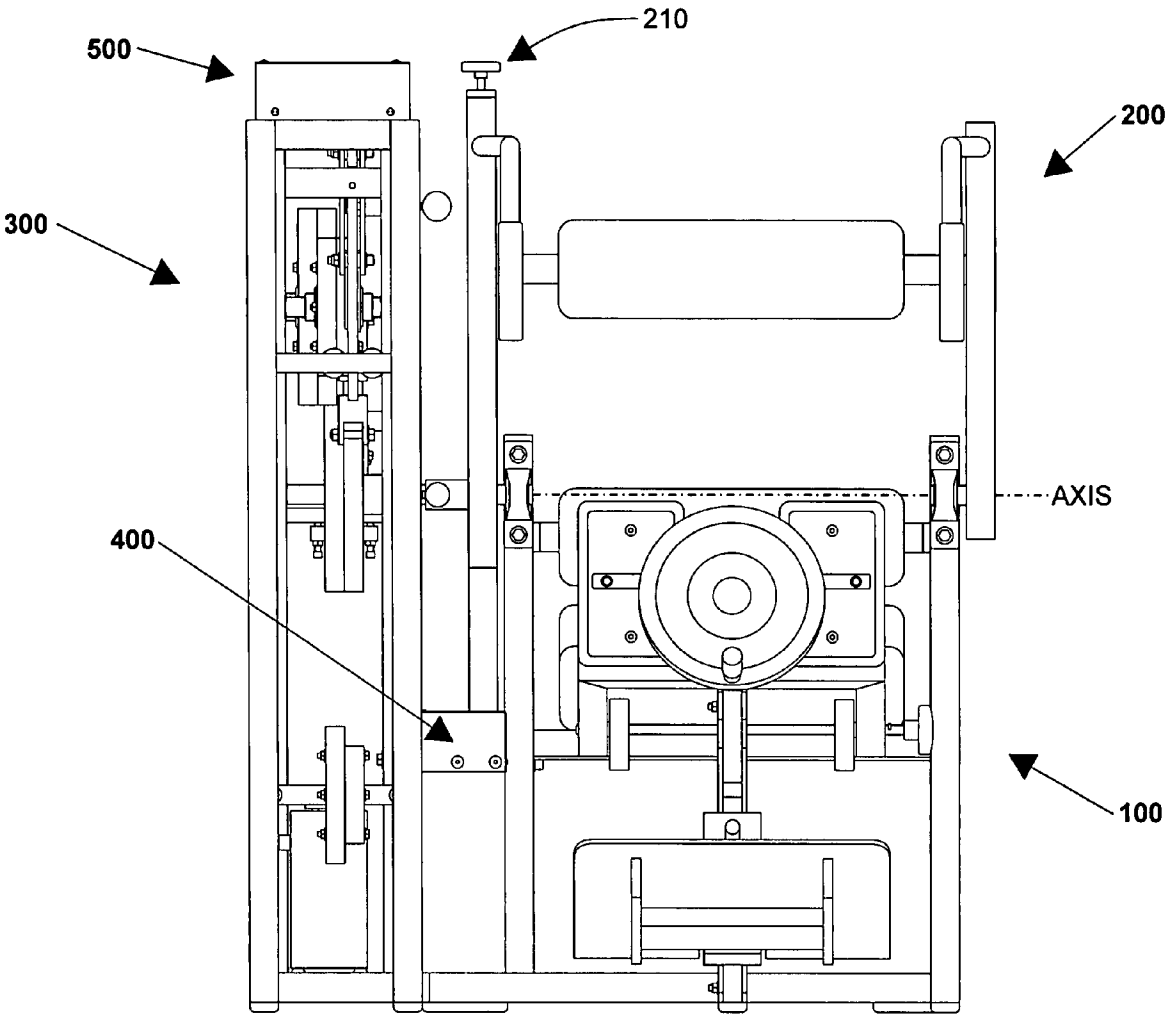
FIG. 4 is a front elevational view of the device of the present invention showing major elements and configurations, however, some parts omitted for clarity.

For a detailed description of the invention the reader is directed to the attached figures wherein like components are given like reference numerals for ease of reference.

Referring first to FIGS. 1-4, the lumbar extension device of the present invention is shown to comprise a seat assembly generally indicated at 100 and a movement arm assembly generally indicated at 200, a resistance mechanism generally indicated at 300, a load cell testing module generally indicated at 400 and a readout module generally indicated at 500. Movement arm assembly 200 is operatively connected to both the resistance mechanism 300 and the seat assembly 100 at the indicated AXIS. The load cell testing module 400 is connected to both the resistance mechanism frame and the seat assembly frame and is positioned to allow engagement of a test mode configuration via test mode engagement generally indicated at 210. The meter readout module 500 is mounted on top of the resistance mechanism frame and contains a repetition count meter and a torque indicator meter. An important element of this device is the axis of rotation of the movement arm and is referred to in all relevant views and FIGURES as the "AXIS" and is indicated with a centerline designation.

Figure 5:
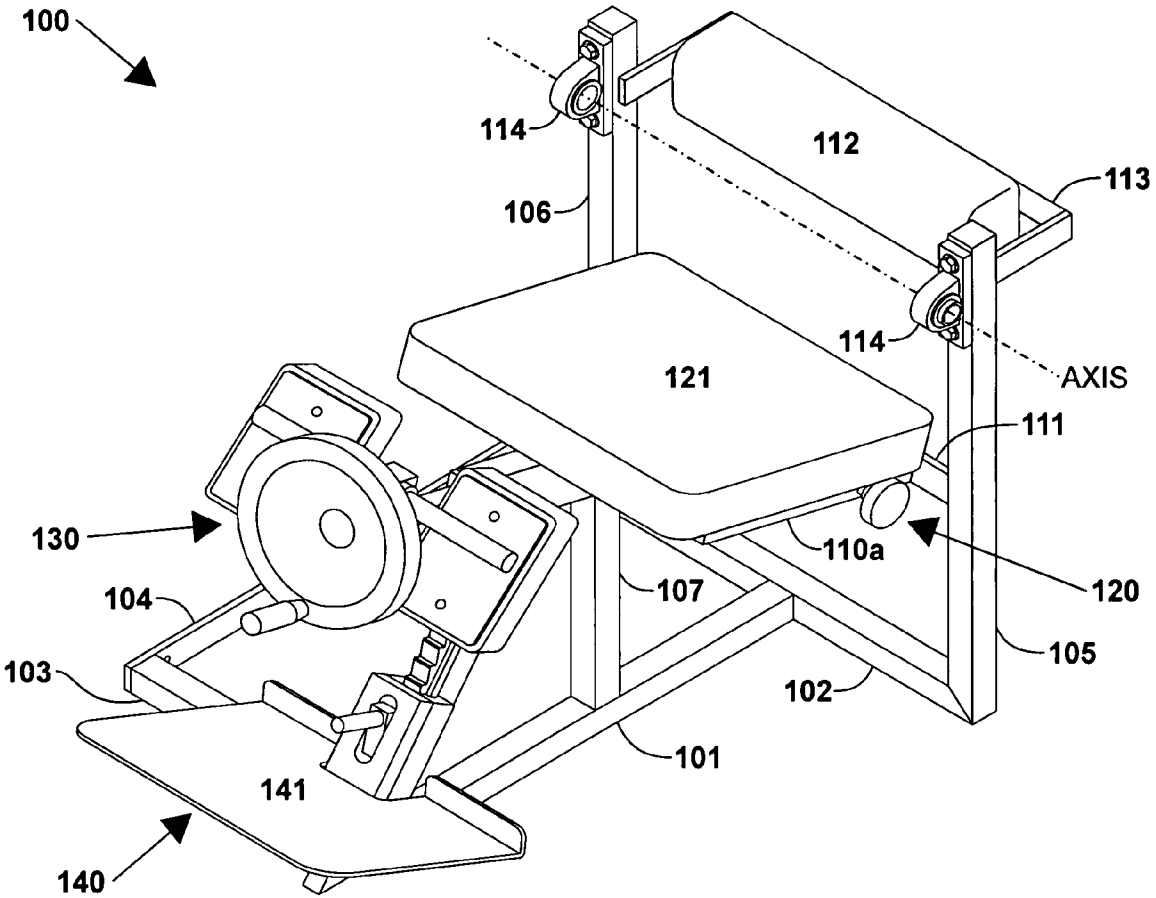
FIG. 5 is an isometric view of the seat assembly of the present invention showing the lower body restraint mechanism.

Referring to FIG. 5, the seat assembly, generally indicated at 100, of the present invention is shown in an isometric view. There is a frame comprised of horizontal members 101, 102, 103, 104 and upright members 105, 106, 107. Preferred frame material is 11 or 14 gauge steel square tubing. Frame member 104 is a solid flat bar and has apertures which mate and match with apertures of the resistance mechanism frame, generally indicated at 300, to allow seat assembly to be securely attached to the resistance mechanism. Securely attached to vertical, upright members 105 and 106 are pillow block bearings 114 which allow and determined the appropriate location and fixation of the "AXIS." Preferred bearings have an extended inner race with dual set screws. Also rigidly fixed to the upright members 105 and 106 is the pelvic restraint frame 113 which provides the firm and appropriate location and support of the pelvic restraint pad 112. A firmly placed and fixed pelvic restraint is an essential element to provide proper lower body restraint and allow safe effective exercise and extension by the subject/exerciser. Also shown is the adjustable seat assembly, generally indicated at 120, of the seat assembly of the present invention. Member 111 provides one of the supports which rigidly attach the adjustable seat assembly 120 and the shin pad restraint mechanism 130 to the seat assembly frame. The adjustable seat assembly is further explained and shown in FIGS. 6, 7, 7A, 8, 8A. Also shown is the shin pad restraint mechanism, generally indicated at 130, of the seat assembly of the present invention. The shin pad restraint mechanism is further explained and shown in FIGS. 9 and 9A. Also shown is the adjustable footboard assembly, generally indicated at 140, of the seat assembly of the present invention. The adjustable footboard assembly is further explained and shown in FIGS. 10 and 10A.

Figure 6:
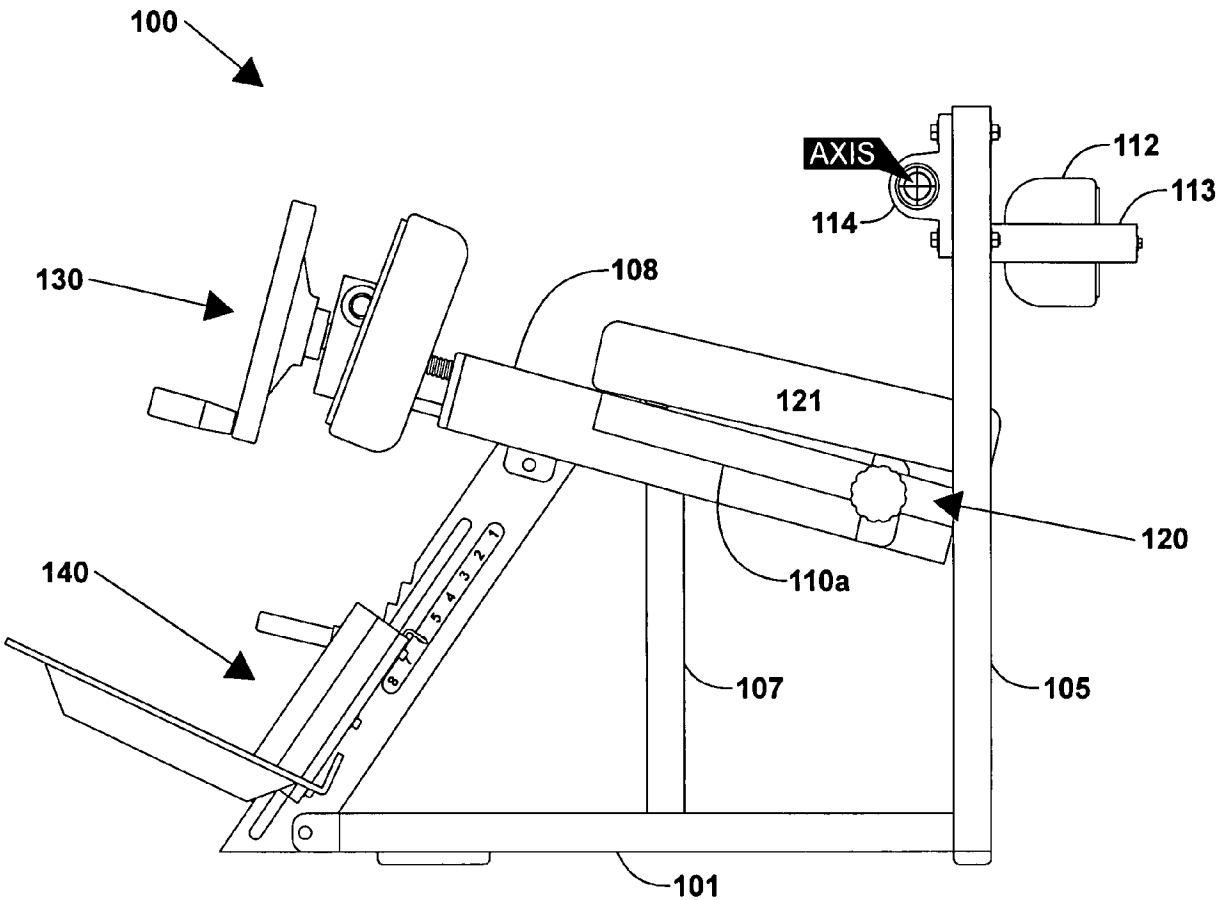
FIG. 6 is a side elevational view of the seat assembly of the present invention showing more details of the lower body restraint mechanism.

Referring to FIG. 6, the seat assembly, generally indicated at 100, of the present invention is shown in a side elevational view. Member 110*a* is part of the adjustable seat assembly frame. Member 108 is part of the seat assembly frame and also the housing for the shin pad restraint mechanism. Shown is basic frame configuration and components for the seat assembly of the present invention.

Figure 7A:
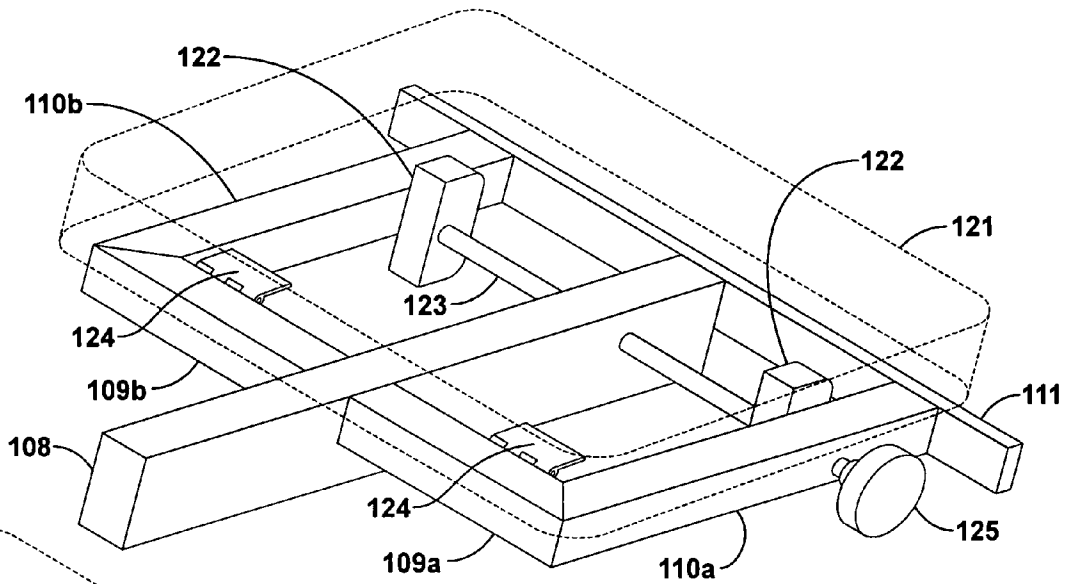
FIG. 7A is an isometric view of the height adjustable seat assembly of the present invention with the seat in the highest position.
Figure 7:
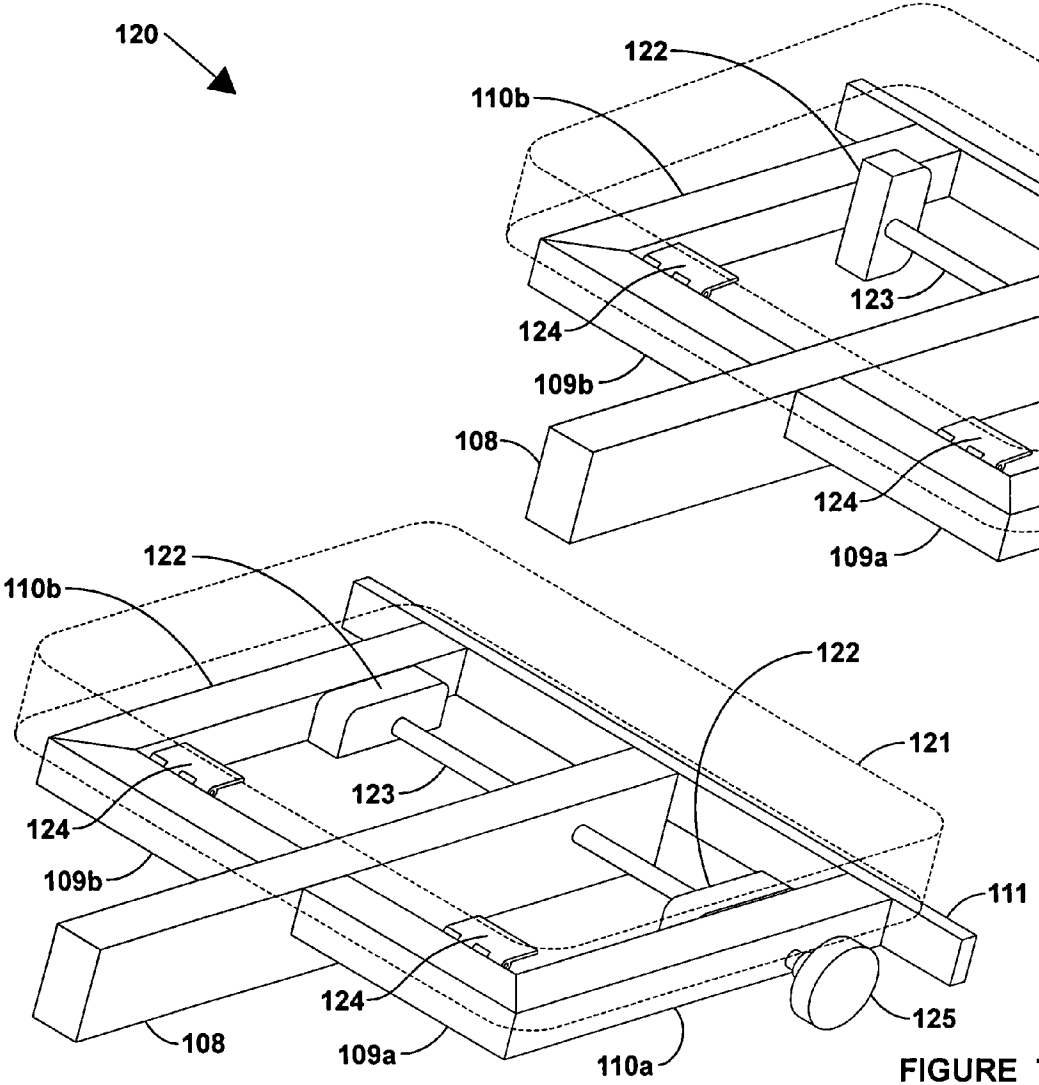
FIG. 7 is an isometric view of the height adjustable seat assembly of the present invention with the seat in the lowest position.

Referring to FIG. 7, the adjustable seat assembly, generally indicated at 120, of the present invention is shown in an isometric view. The padded seat 121 is firmly and securely attached to the adjustable seat frame by hinges 124. The adjustable seat frame members 109*a*, 109*b*, 110*a*, 110*b*, are firmly and securely attached to frame member 111 and frame member 108 which is also the housing for the shin pad restraint mechanism 130. Frame member 111 is firmly and securely attached to upright members 105 and 106 shown in FIG. 5. In this view, the seat 121 is shown in the lowest position. Positional adjustment, i.e. height, is accomplished by turning a knob 125 which rotates a shaft 123. Securely attached and affixed to the shaft are two 3 lobe cams 122 which contact the underside of the padded seat 121.

Referring to FIG. 7A, the adjustable seat assembly, generally indicated at 120, of the present invention is shown in an isometric view. In this view, the seat 121 is shown in the highest position. Appropriate seat adjustment, position, should be noted on subject/exerciser records for future use and pre-session setup.

Figure 8A:
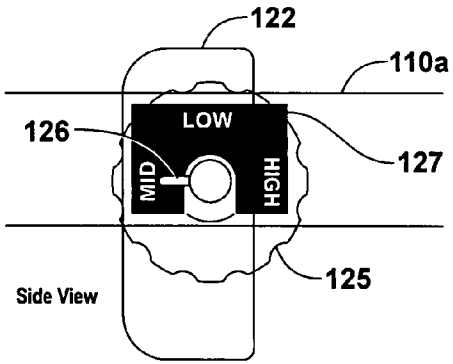
FIG. 8A is a side elevational view of the height adjustable seat assembly of the present invention showing the adjusting cam.
Figure 8:
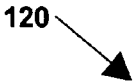
FIG. 8 is a front elevational view of the height adjustable seat assembly of the present invention showing the components and configuration.
Figure 8:
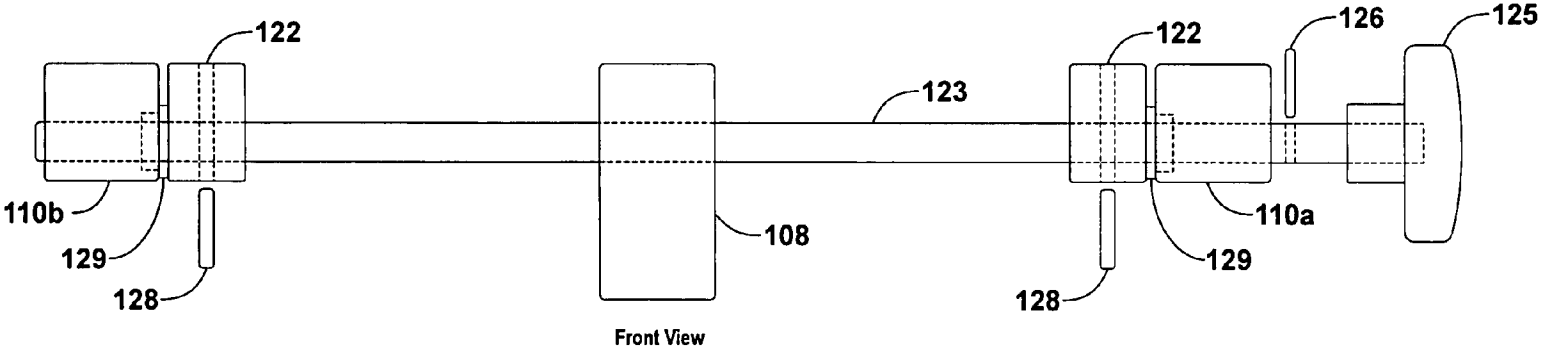

Referring to FIG. 8, the components and configuration the adjustable seat assembly 120 of the present invention are shown in a front view. Two 3 lobe cams 122 are securely attached and affixed to the shaft 123 by a preferred means of roll pins 128. Adjustment shaft passes through apertures in seat frame members 110*a* and 110*b* and shin pad restraint mechanism housing 108. The shaft 123 is passes through and is supported by flanged bushings, bearings, 129 which are placed in frame members 110*a* and 110*b*. Adjustable seat height, position, is achieved by rotating a knob 125 rigidly attached and fixed to the shaft 123. A preferred knob is a lobed model which allows for easier and more positive rotation of the knob and assembly adjustment. A seat position indicator pin 126 is firmly attached and fixed to the shaft outside frame member 110*a*.

Referring to FIG. 8A, the adjustable seat assembly 120 of the present invention is shown in a detail view. Knob 125 may be rotated in either direction to select the appropriate seat height position. Seat height position is indicated by a pointer pin 126 and a decal/label 127 which is affixed to the outside of seat frame member 110*a* and around shaft 123. The importance of seat height adjustment will become clear in following information and detail, see FIG. 11.

Figure 9A:
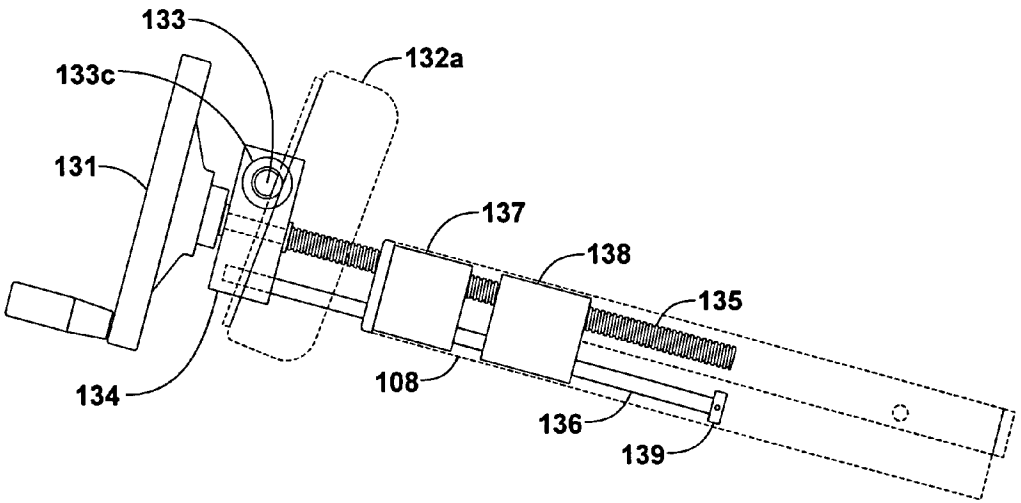
FIG. 9A is a side elevational view of the shin pad restraint mechanism of the present invention showing the components and configuration.
Figure 9:
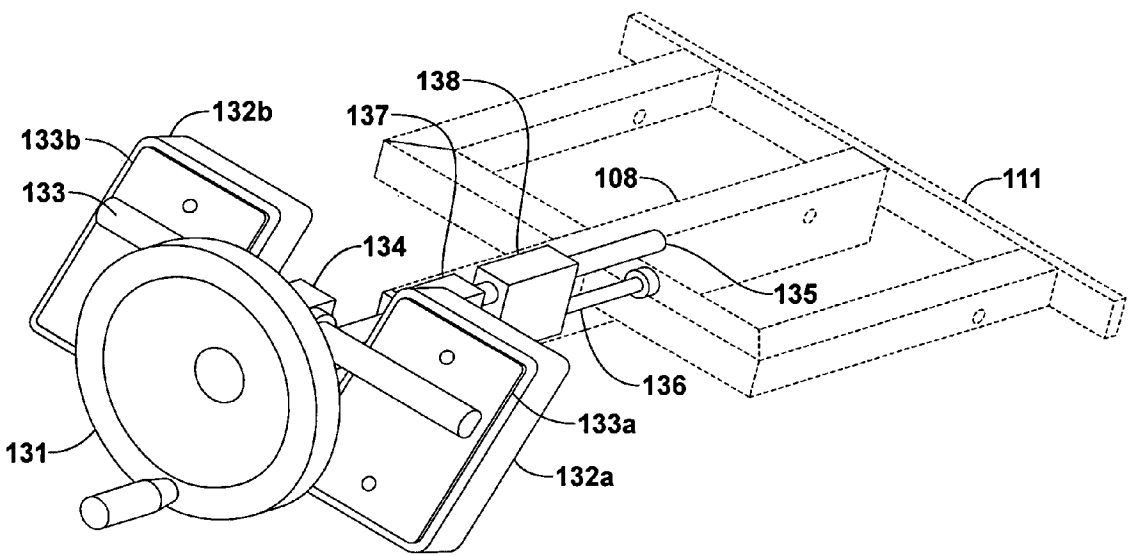
FIG. 9 is an isometric view of the shin pad restraint mechanism of the present invention showing the components and configuration.

Referring to FIG. 9, the shin pad restraint assembly, generally indicated at 130, of the present invention is shown in an isometric view. A suitable hand wheel 131, preferably with knob, is rigidly attached and fixed to a long threaded shaft, screw 135. The hand wheel end of screw 135 is machined to allow passage through a pair of flanged bushings, not shown, which are positioned in a housing block 134. Flanged bushings allow positive, smooth axial rotation of screw to bring appropriate restraint force when the hand wheel 131 is rotated. Clockwise rotation of the hand wheel brings application of force, counter-clockwise rotation releases force. Screw 135 passes through threaded blocks 137 and 138 which are rigidly attached and fixed inside frame member 108. Preferred material for threaded blocks is a low friction plastic such as NYLATRON which allows smooth, positive movement of restraint mechanism. Restraint pads 132*a* and 132*b* are firmly mounted and fixed on plates 133*a* and 133*b* which are firmly attached and fixed to shaft 133.

Referring to FIG. 9A, the shin pad restraint assembly, generally indicated at 130, of the present invention is shown in a side elevational view. Pad mounting shaft 133, passes through and is supported by a pair of flanged bushings, not shown, which are positioned in housing block 134. Flanged bushings allow positive, smooth rotation of restraint pads 132*a* and 132*b* and pad shaft 133. Shaft 133 is held in proper position by means of shaft collars 133C. Threaded blocks 137 and 138 are also machined to receive and allow smooth passage of guide and stabilizer rod 136. On one end, guide rod 136 is firmly attached and fixed inside housing block 134. On the other end a shaft collar 139 is fixed to guide rod 136 to limit the travel of restraint mechanism. Combination of threaded screw 135 and guide rod 136 and both blocks 137 and 138 allows for firm, smooth and positive application of appropriate restraint force to subject/exerciser. The importance of proper restraint force application will become clear in following information and detail, see FIG. 11.

Figure 10A:
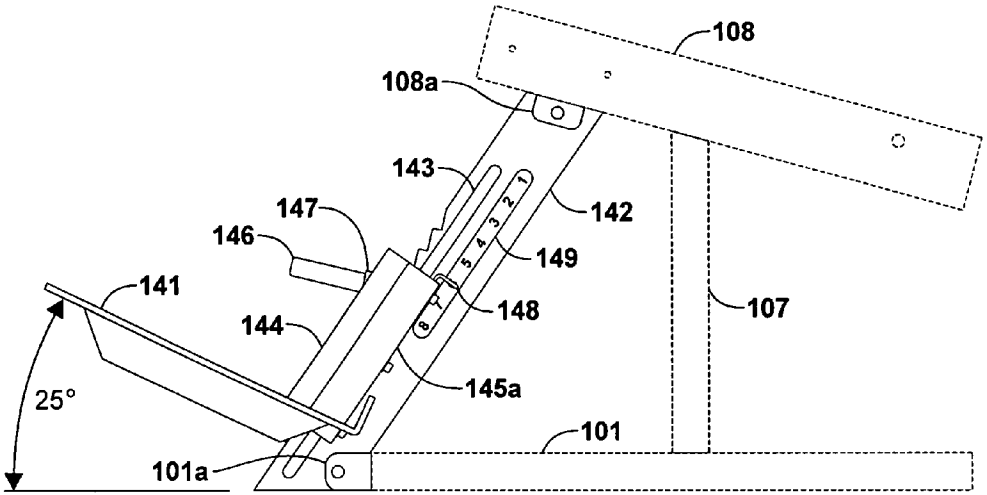
FIG. 10A is a side elevational view of the adjustable footboard assembly of the present invention showing the components and configuration.
Figure 10:
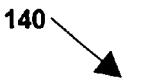
FIG. 10 is an isometric view of the adjustable footboard assembly of the present invention showing the components and configuration.
Figure 10:
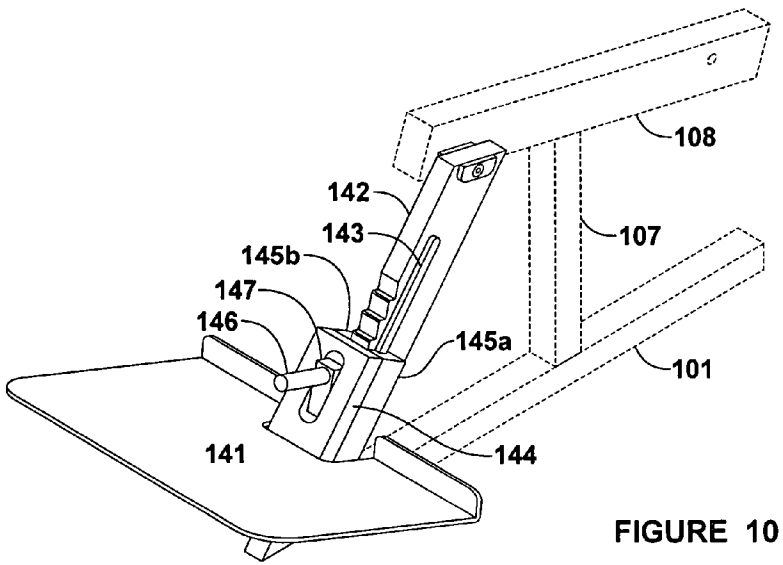

Referring to FIG. 10, the adjustable footboard assembly, generally indicated at 140, of the present invention is shown in an isometric view. The footboard assembly is supported by a notched rack member 142. The preferred material for this rack is solid aluminum. This rack member 142 is machined to receive a smooth guide bar 143 which is rigidly attached and fixed to rack 142 and extends out each side to provide a slide surface for smooth longitudinal movement of the footboard assembly. Preferred material for this bar is polished brass or stainless steel. Footboard 141 is rigidly attached and fixed to a housing block 144. Rigidly attached and fixed to the housing block 144 are two grooved or slotted guide blocks 145*a* and 145*b* which are matched and machined to accept the protruding edges of the guide bar 143. The preferred material for the guide blocks 145*a* and 145*b* is a low friction, yet strong plastic such as NYLATRON. The housing block is machined to accept handle 146 and pawl 147 which are pivotally mounted inside housing block 144 to allow upward movement and positioning of footboard 141 by a ratcheting action. Downward movement and footboard 141 positioning are achieved by manipulating the handle 146 and pawl 147.

Referring to FIG. 10A, the adjustable footboard assembly, generally indicated at 140, of the present invention is shown in a side elevational view. The preferred angle of the footboard 141 is twenty-five degrees from horizontal. The preferred configuration should provide for and allow consistent angular relationships of lower body parts for the subject/exerciser regardless of body size or morphology. A position indicator pin 148 attached and fixed to guide block 145*a* indicates footboard position relative to a decal/label 149 attached to the rack member 142. Notched rack member 142 is rigidly attached and fixed to frame member 108 by a pair of mounting tabs 108*a* and to the lower seat frame member 101 by another pair of mounting tabs 101*a*. The importance of proper footboard positioning will become clear in following information and detail, see FIG. 11.

Figure 11:
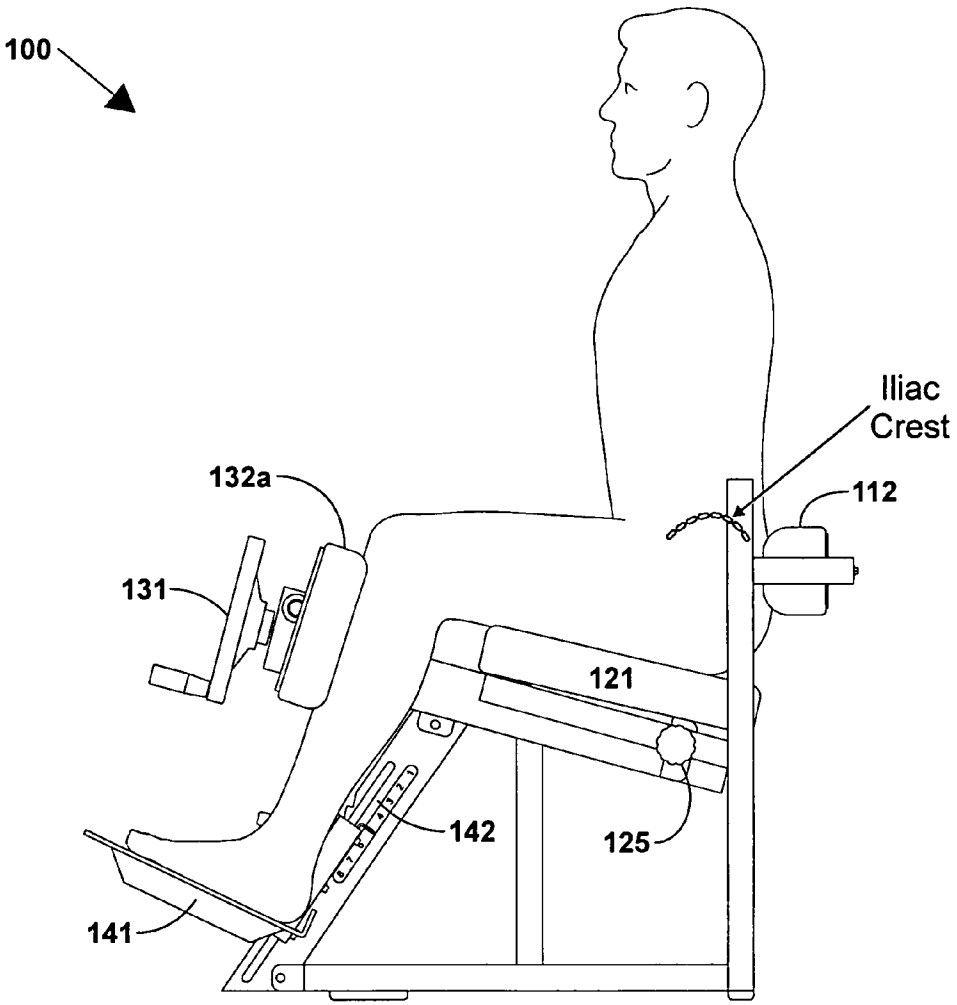
FIG. 11 is a side elevational view of the seat assembly and restraint mechanism of the present invention with a subject/exerciser positioned and restrained therein.

Referring to FIG. 11, the seat assembly, generally indicated at 100, of the present invention is shown in a side elevational view with a subject/exerciser positioned and restrained therein. Shown are the major elements of this preferred embodiment of the seat assembly which allow and provide proper subject/exerciser position and lower body restraint. In order to effectively and safely apply therapeutic exercise to the lumbar extensor muscles, it is necessary to properly position the subject/exerciser and appropriately restrain the lower body to eliminate or limit influence and participation of the lower body on upper body exercise above the stabilized and immobilized pelvis. It is essential that the subject/exerciser be positioned so that the iliac crest is at or near the top of the pelvic restraint 112 so that in extension exercise the vertebrae are allowed to safely extend over the pelvic restraint 112. The footboard 141 should be raised or lowered so that the subject/exerciser's thigh, femur, is approximately aligned with the padded seat 121. A suitable restraint force should be applied by turning the hand wheel 131 in order to exert force to the shins through contact with the shin pads 132*a* and 132*b*. The amount or degree of appropriate restraint force will likely change or vary from session to session or during a rehabilitation program. Appropriate seat adjustment and footboard position should be noted on subject/exerciser records for future use and pre-session setup.

Figure 12:
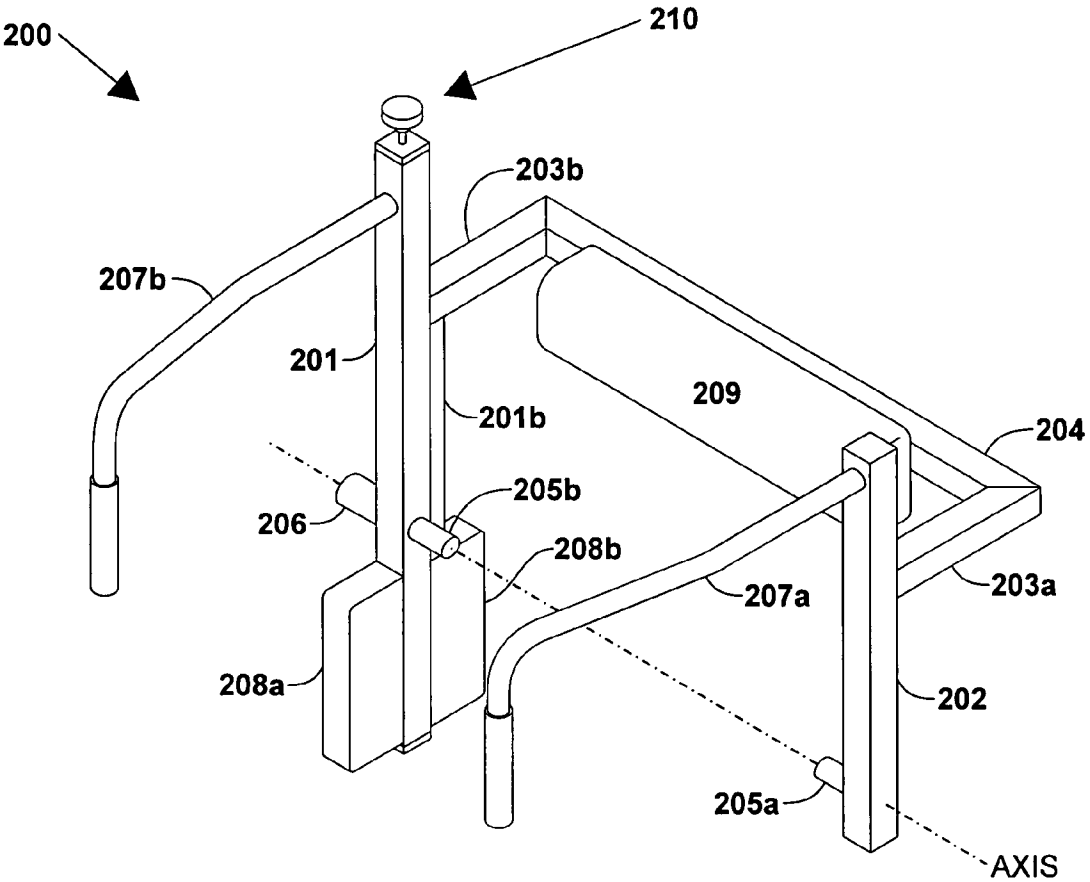
FIG. 12 is an isometric view of the movement arm assembly of the present invention showing major elements of the movement arm assembly and resistance pad.

Referring to FIG. 12, the movement arm assembly, generally indicated at 200, of the present invention is shown in an isometric view. The frame of the movement is formed by upright, vertical members 201 and 202. Preferred material for frame members is 11 or 14 gauge steel square tubing. Members 203*a* and 203*b* and 204 form the frame to support the pivoting resistance pad 209 which is shown in greater detail in FIG. 13, 13A, 13B. Two formed, shaped, handlebars 207*a* and 207*b* are rigidly attached and fixed to the frame by means of apertures in the upper ends of members 201 and 202. On the bottom, lower end of member 201 there are rigidly attached and fixed two solid counterweights 208*a* and 208*b*. The two counterweights offset the weight and mass of the movement arm assembly to allow a smoother and more balanced movement. Positioned at the precise AXIS alignment point on movement arm frame members 201 and 202 are two shafts 205*a* and 205*b*. When the device is fully assembled, these two shafts 205*a* and 205*b* are journalled in the two pillow block bearings 114 rigidly attached and fixed to the upper ends of seat assembly frame members 105 and 106, see FIGS. 5 and 6. On the other side of member 201 from shaft 205*b* is a machined collar 206 also aligned on the AXIS and rigidly attached and fixed to member 201 and shaft 205*b*. This collar allows rigid connection to the cam shaft 342 which protrudes from the resistance mechanism, generally indicated at 300. See FIGS. 16 and 17. For added strength and stiffness, member 201*b* is rigidly attached and fixed to members 201, 203*b* and counterweight 208*b*. The test mode engagement mechanism, generally indicated at 210, is shown with greater detail in FIGS. 15 and 15A.

Figure 13:
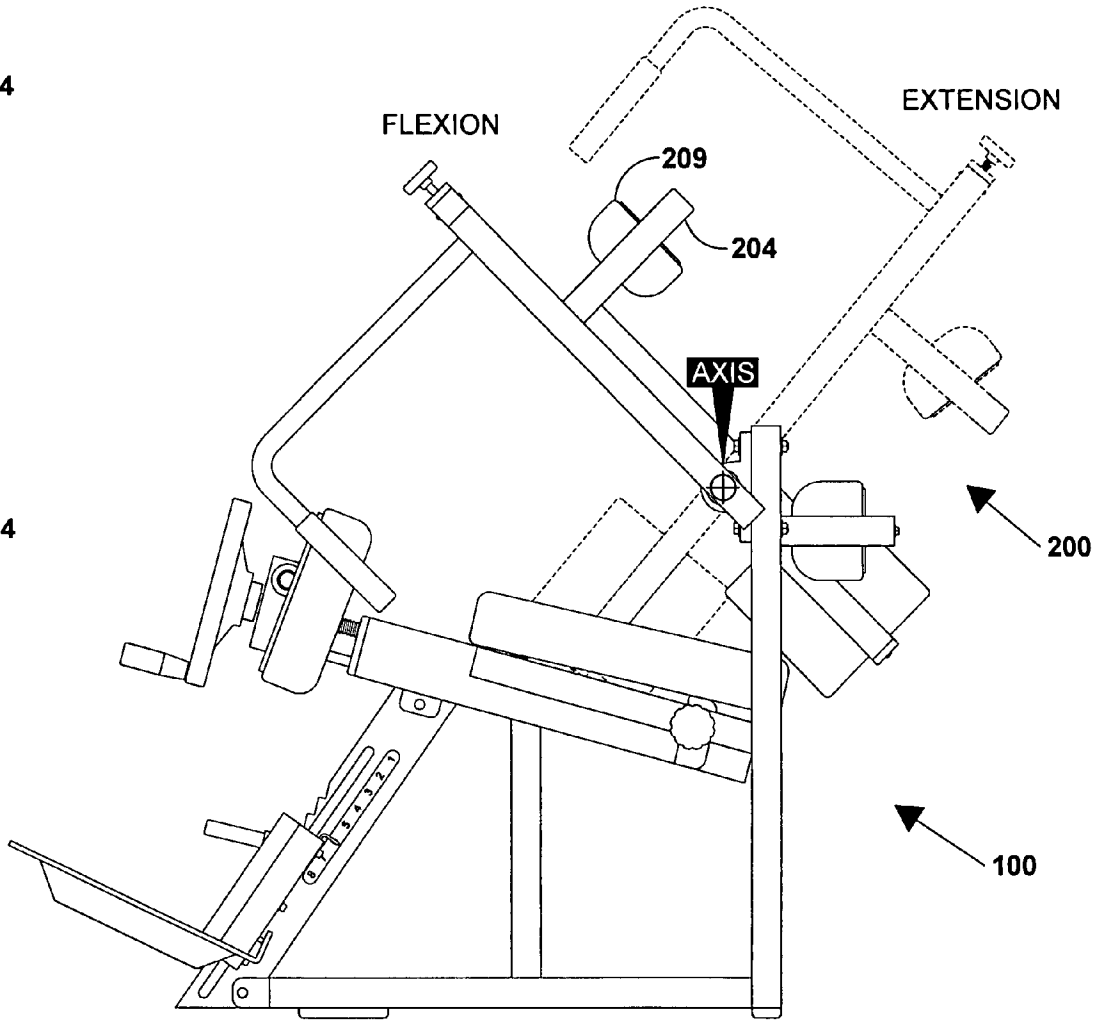
FIG. 13 is a side elevational view of the seat assembly and movement arm assembly of the present invention showing relative configuration from flexed position to extended position.

Referring to FIG. 13, the movement arm assembly, generally indicated at 200, and the seat assembly, generally indicated at 100, of the present invention are shown in a side elevational view. When the two assemblies are operatively connected at the AXIS, the movement arm can rotate clockwise or counterclockwise in a smooth, balanced manner. As the subject/exerciser moves from flexion to extension, the spine grows or elongates as the lumbar vertebral facet joints encounter each other. To avoid unwanted friction or rubbing between the resistance pad 209 and the subject/exerciser's back, the resistance pad 209 is mounted pivotally on movement arm frame member 204.

Figure 13B:
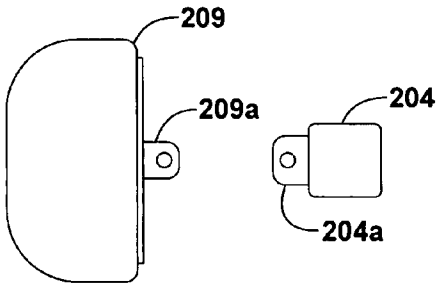
FIG. 13B is a side elevational view of the pivoting resistance pad of the present invention showing the components and configuration.
Figure 13A:
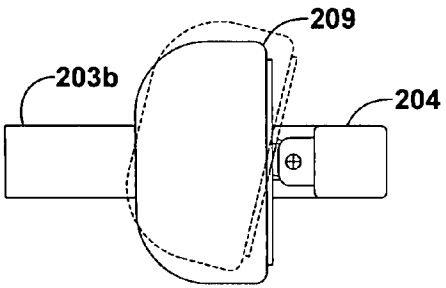
FIG. 13A is a side elevational view of the pivoting resistance pad of the present invention showing typical movement during use and operation.

Referring to FIGS. 13A and 13B, the pivoting resistance pad 209 is shown in detail. A pair of mounting tabs are rigidly attached and fixed to frame member 204. A resistance pad mounting bar 209*a* is rigidly attached and fixed to the back of resistance pad 209. The resistance pad 209 is suitably connected in such a manner to allow upward movement of the resistance pad 209 to accommodate the growth or lengthening of the subject/exerciser spine and avoid unwanted friction or rubbing. Initial positional relationship of the subject/exerciser back and the resistance pad 209 is determined by a pair of stop bumpers, not shown.

Figure 14:
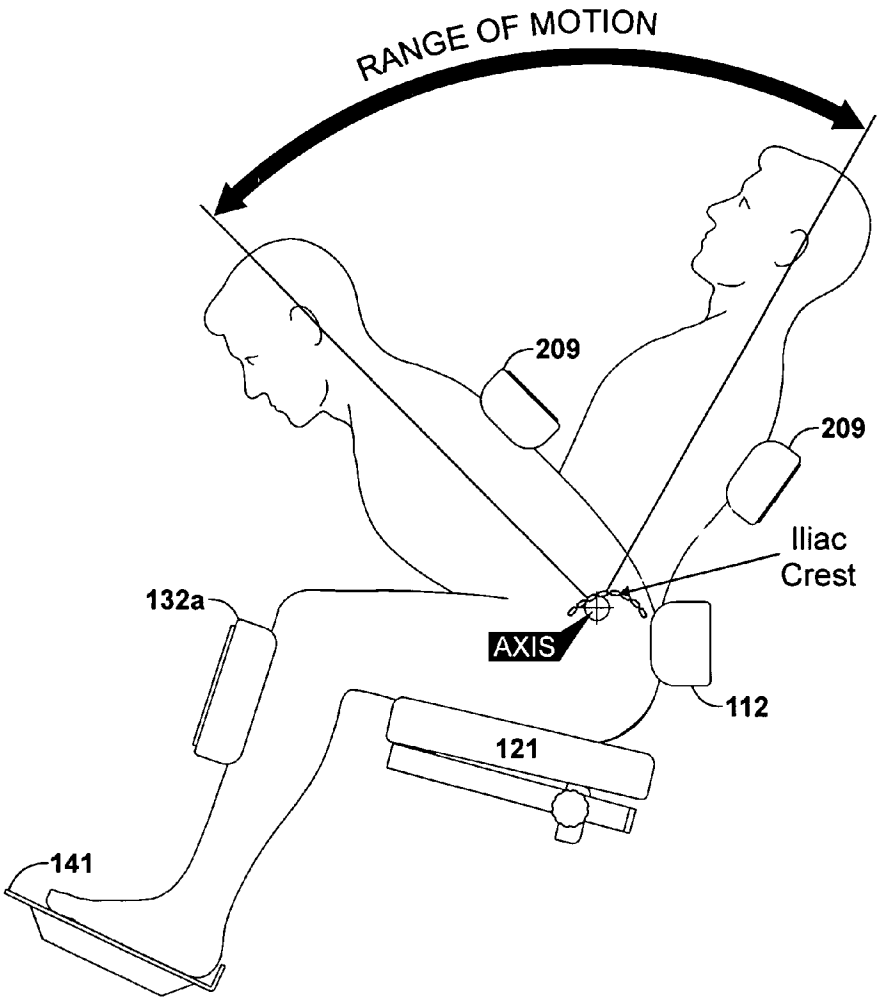
FIG. 14 is a side elevational view of the present invention showing the subject/exerciser in the two extreme positions.

Referring to FIG. 14, the range of motion movement of the present invention is shown in a side view. When properly positioned by the seat 121 and pelvic restraint pad 112 and properly restrained by the shin restraint pads 132*a* and 132*b* and footboard 141, the subject/exerciser can rotate or move through all or any portion of an available eighty-five (85) degree range of motion. While the normal range of motion of the lumbar spine for an average, uninjured subject/exerciser is probably 70-75 degrees, several factors such as age, body morphology, overall condition, etc. can determine individual range of motion and end points, this device allows for an available 85 degree movement. Subject/exerciser should always be instructed and cautioned to only perform exercise through "their" greatest pain-free range of motion.

In all instances, any treatment or rehabilitation program or use of apparatus should be preceded by an appropriate physical examination and the program prescribed and monitored by a qualified medical professional. In all instances, the patient, subject, exerciser should be instructed to perform all exercise repetitions throughout "their" greatest pain-free range of motion. A repetition is considered to be a full range movement in a controlled, deliberate manner with good form and good pace. When exercising to fatigue is the goal, the session should cease when the subject/exerciser loses good form or good pace. When performing strength tests, the subject should be instructed to give their best, pain-free effort. Subject should slowly build to maximum effort and slowly release. Care should be taken and caution given against over-exertion and any action or effort which produces pain. Subject should be cautioned against tightly gripping the handlebars during any test or exercise procedures. Tightly gripping the hands can result in a significant increase in blood pressure during extreme physical exertion.

Figure 15:
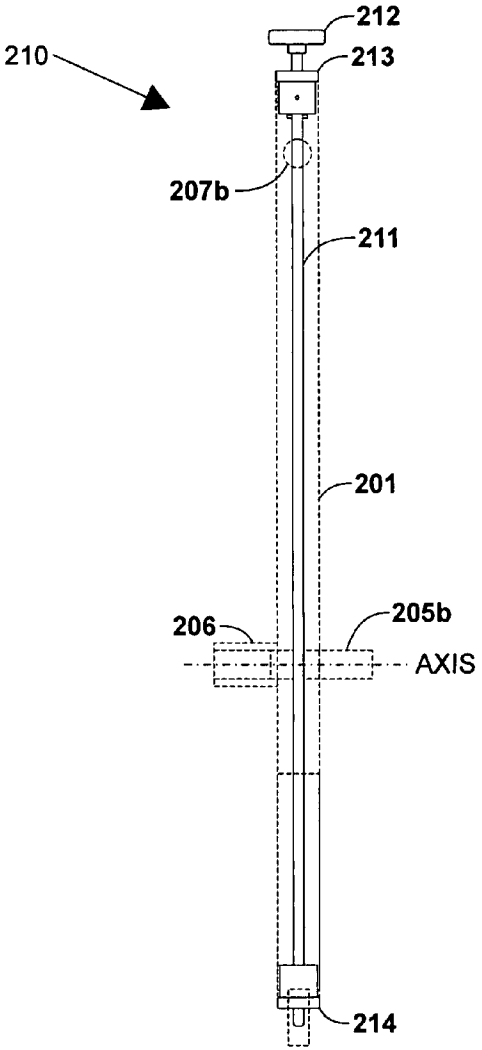
FIG. 15 is a side elevational view of the test mode engagement mechanism of the movement arm assembly of the present invention showing components and configuration.

Referring to FIG. 15, the test mode engagement mechanism, generally indicated at 210 of the movement arm assembly of the present invention is shown in a side view. Mechanism is housed inside movement arm frame member 201. There is a shaft 211 which is rigidly attached and fixed to a knob 212. Engagement shaft 211 passes through and is positioned by a machined upper housing and guide block 213 and lower guide block 214. Engagement shaft also passes through apertures in handlebar 207*b* inside member 201 and also through aperture in shaft 205*b* also inside member 201.

Figure 15A:
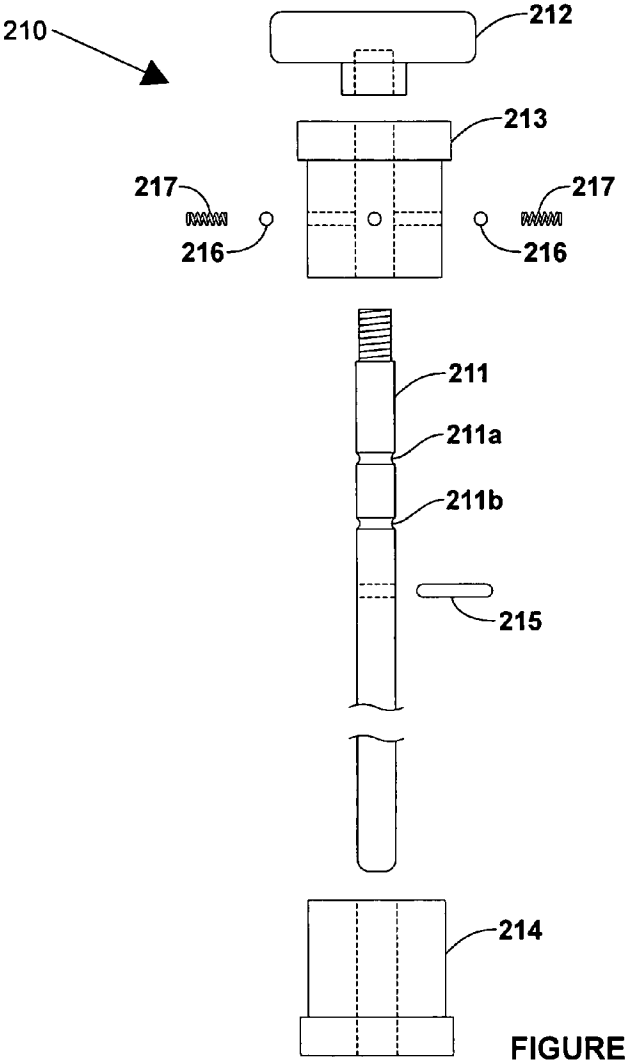
FIG. 15A is an exploded view of the components of the test mode engagement mechanism of movement arm assembly of the present invention.

Referring to FIG. 15A, the parts and components of the test mode engagement mechanism, generally indicated at 210, of the present invention are shown in an exploded view. Engagement shaft 211 is machined to accept knob 212. Engagement shaft has a pair of grooves 211*a* and 211*b* which provide "engaged" and "disengaged" positions for test mode engagement mechanism 210. Preferred material for engagement shaft is stainless steel. An upper housing and guide block 213 is machined to allow free passage of engagement shaft and also to contain and operatively apply a pair of position retainer balls 216 and a pair of position retainer springs 217. A lower guide block 214 allows free passage of engagement shaft 211. Preferred material for guide blocks 213 and 214 is a low friction plastic such as NYLATRON. A limit pin 215 is affixed in an aperture in shaft 211 to limit upward movement of test mode engagement shaft 211. Test mode engagement mechanism is securely attached and fixed inside the movement arm frame member 201 by means of tamper resistant screws, not shown, which pass through apertures in member 201 wall and into upper guide block 213 and lower guide block 214.

Figure 16:
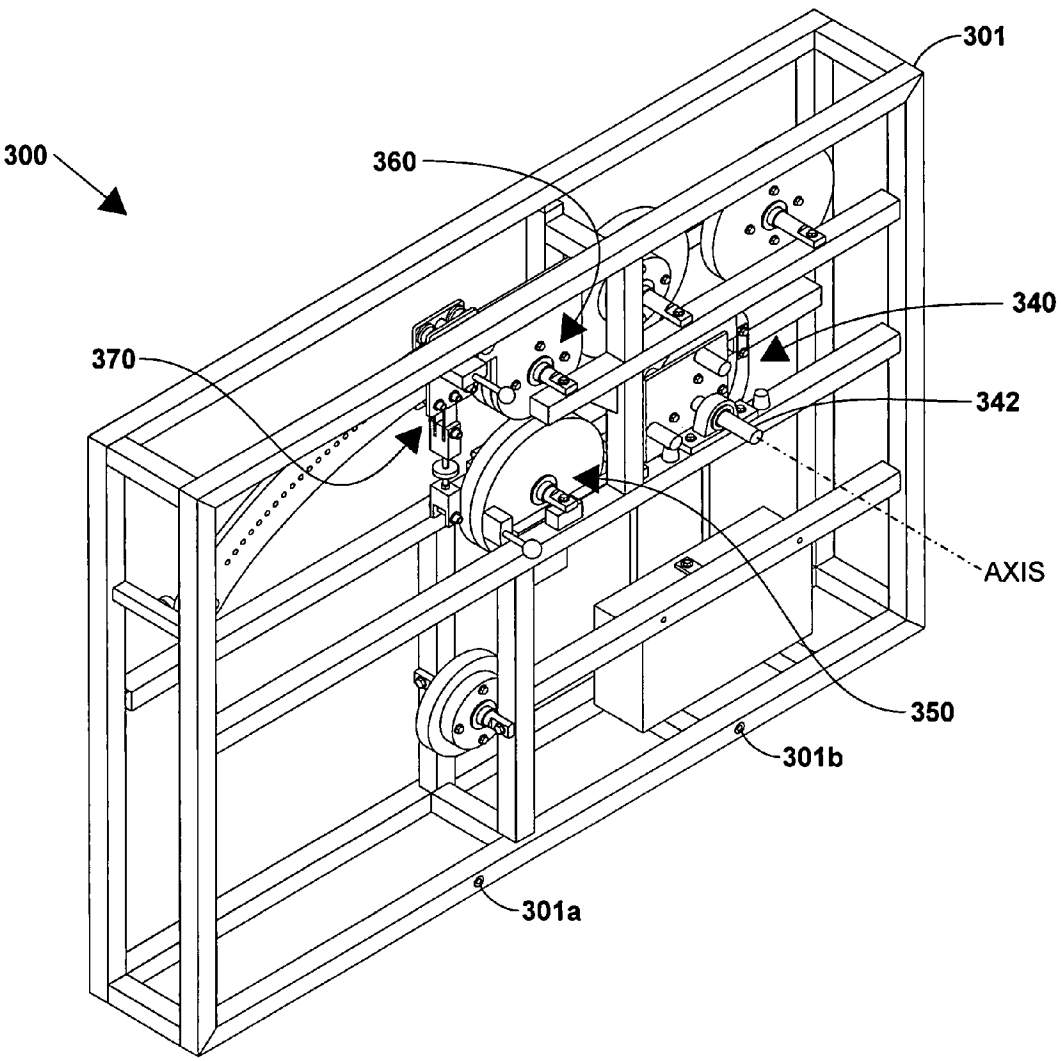
FIG. 16 is an isometric view of the resistance mechanism of the present invention showing major elements and components.

Referring to FIG. 16, the resistance mechanism, generally indicated at 300, of the present invention is shown in an isometric view. (Some parts not shown for clarity) The resistance mechanism is housed in a frame structure generally indicated at 301. Preferred material for frame members is 11 or 14 gauge steel square tubing. The major components of the resistance mechanism 300 are: the camshaft and cam assembly, generally indicated at 340; the range of motion selector and resistance engagement mechanism, generally indicated at 350; the resistance arc/lever assembly, generally indicated at 360; and the resistance selector mechanism, generally indicated at 370. The AXIS is indicated at the protruding cam shaft 342 which operatively connects to the movement arm assembly collar 206, see FIG. 12. The resistance mechanism 300 also rigidly and securely connects to the seat assembly 100 with bolts and lock washers through apertures on seat frame member 104, see FIG. 5, at points 301*a* and 301*b* on resistance mechanism frame 301.

Figure 17:
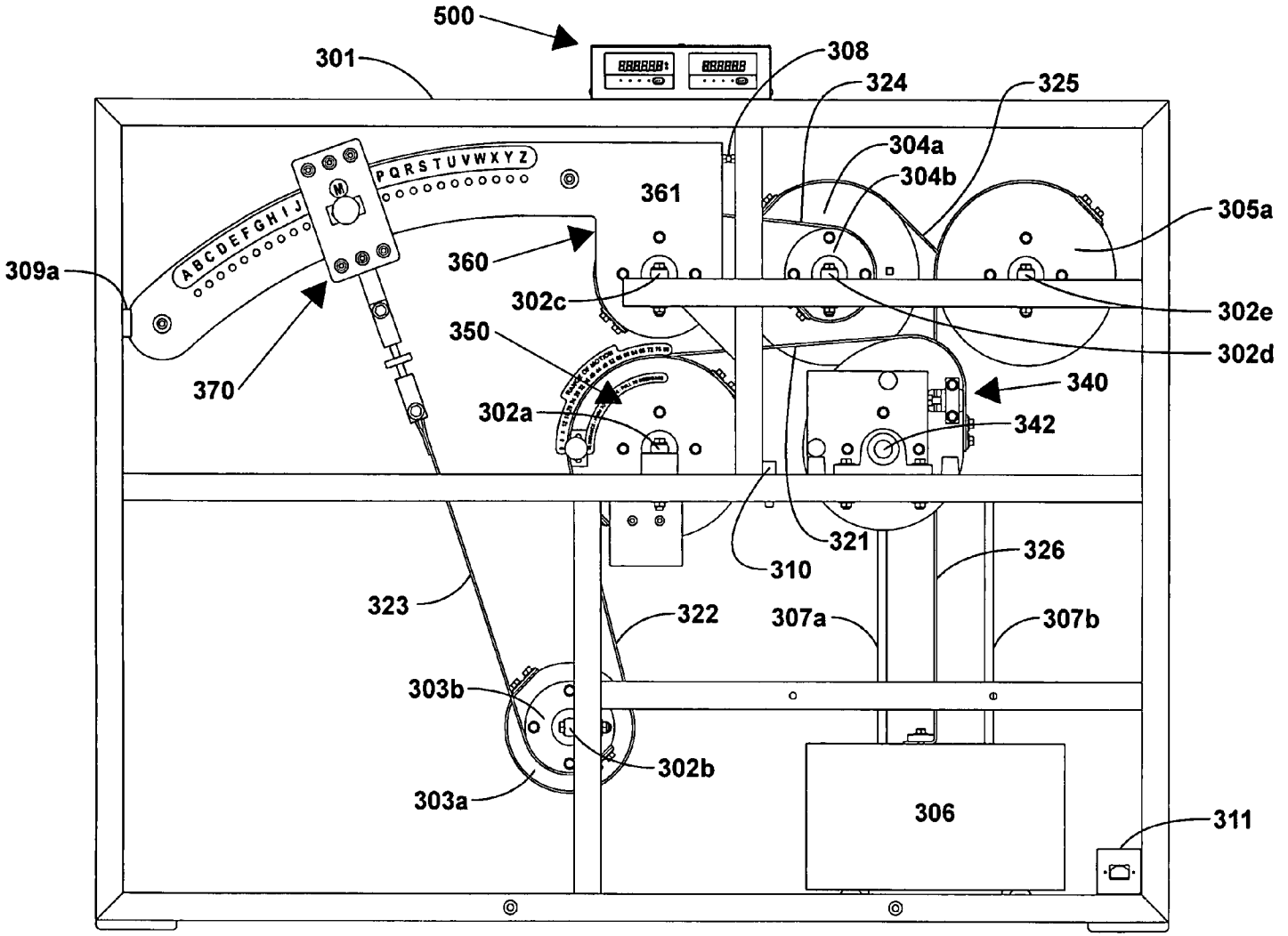
FIG. 17 is a side elevational view of the resistance mechanism of the present invention showing more details of the components and configuration.

Referring to FIG. 17, the resistance mechanism, generally indicated at 300, of the present invention is shown in a side elevational view. The mechanism is contained in a steel tubular frame 301. Most moving parts and components are mounted, journalled with bearings, on machined shafts 302*a, b, c, d, e*. Preferred material for shafts is stainless steel. Shafts and components are mounted with appropriate nuts, blots and washers through apertures on frame members. Camshaft and cam assembly, generally indicated at 340, are explained in detail in FIGS. 18 and 18A. Camshaft 342 is also the AXIS and entry point of movement, motion and force from the movement arm assembly, generally indicated at 200. Camshaft and cam assembly 340 are mounted near the vertical middle and horizontal rear of the resistance mechanism. Camshaft and cam assembly 341 are connected to the range of motion selector and resistance engagement mechanism by belt 321. The range of motion selector and resistance engagement mechanism, generally indicated at 350, is mounted, journalled with bearings, on shaft 302*a* at the same horizontal position and somewhat forward of the cam assembly 340. The range of motion selector and resistance engagement mechanism, generally indicated at 350 is explained in detail in FIGS. 19 and 19A. The range of motion and resistance engagement mechanism 350, is connected by belt 322 to a 7 inch diameter pulley 303*a*. A 5 inch diameter pulley 303*b* is connected rigidly and concentrically with the 7 inch pulley 303*a*, journalled with bearings on shaft 302*b*. Pulley 303*b* is connected by belt 323 to the resistance selector mechanism, generally indicated at 370. The resistance selector mechanism 370 is explained in detail in FIGS. 21 and 21A. The resistance selector mechanism 370 is attached operatively to the resistance arc/lever, generally indicated at 360. The resistance selector mechanism 370 can selectively traverse the arc portion of the resistance arc/lever 361 relative to a radius point at the forward and middle edge of the lower 5 inch pulley 303*b*. The resistance arc/lever 361 is rigidly and concentrically connected with 7 diameter inch pulley 362*a* (not shown see FIGS. 20 and 22) and spacer 362*b* (not shown see FIGS. 20 and 22), journalled with bearings on shaft 302*c*. The resistance arc/lever, generally indicated at 360, is shown in detail in FIGS. 20 and 20A. The resistance arc/lever assembly 360 is connected by belt 324 to another 5 diameter inch pulley 304*b*. Pulley 304*b* is connected rigidly and concentrically with a 10 inch diameter pulley 304*a*, journalled with bearings on shaft 302*d*. Pulley 304*a* is connected by belt 325 to a 5 inch pulley 305*b* not shown (see FIG. 22). Pulley 305*b* is connected rigidly and concentrically with another 10 inch diameter larger pulley 305*a*, journalled with bearings on shaft 302*e*.

Figure 23:
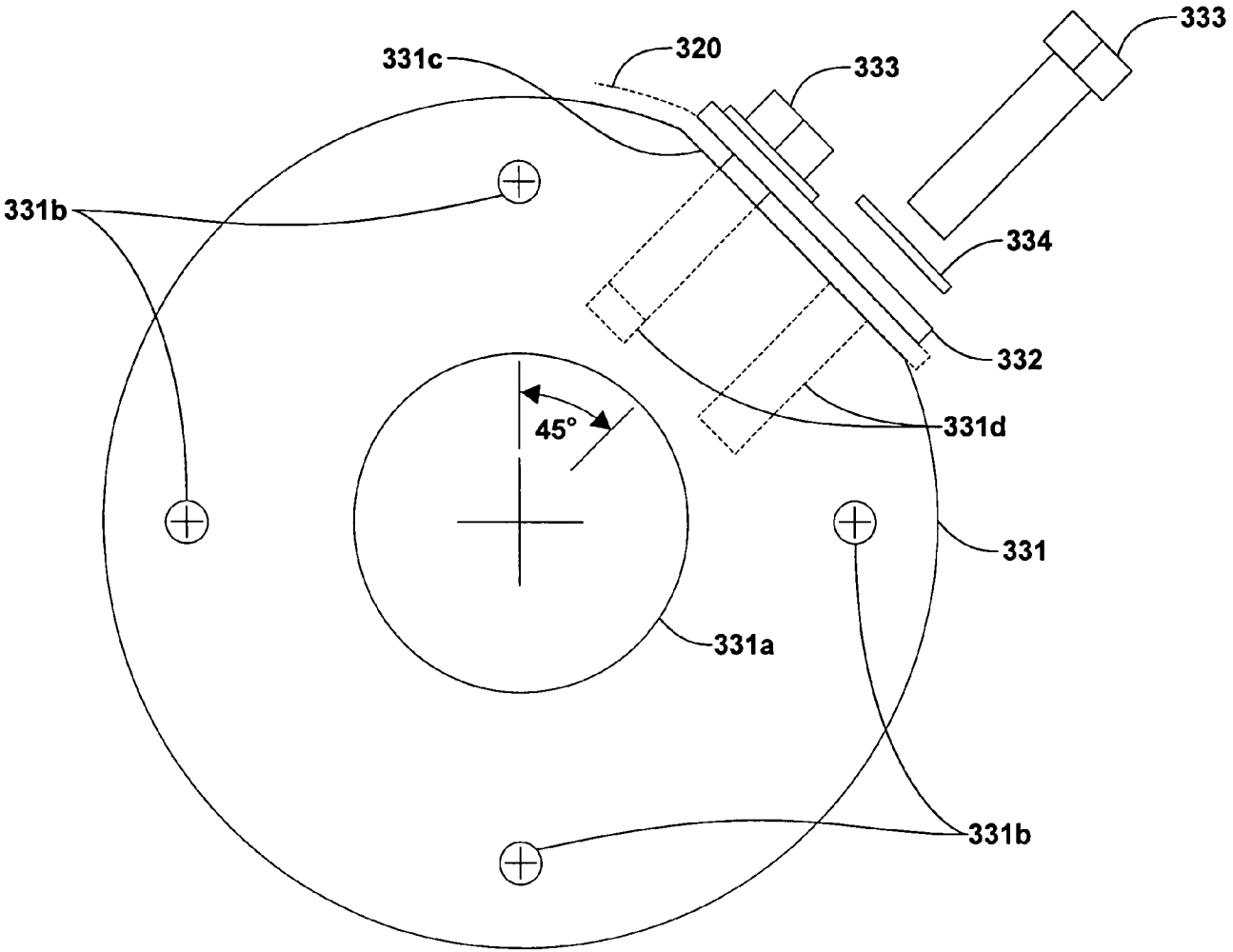
FIG. 23 is a side view of a typical belt and pulley connection used in several places and configurations in the resistance mechanism.

Pulley 305*a* is connected by belt 326 to dead weight 306. Dead weight 306 travels vertically by means of a guide block 306*a*, not shown. Guide rods 307*a* and 307*b* pass through apertures in guide block 306*a* and allow free and easy movement of dead weight 306 during exercise or use. Preferred belt material is a super strong, non-stretch material such as KEVLAR. Preferred method for mounting and/or attaching belts to pulleys is shown in FIG. 23. A means for adjusting and positioning the resistance arc/lever 361 is provided by a bolt and lock/jam nut at 308. A means for supporting resistance arc/lever 361 during resistance selection is provided by two round rollers 309*a* and 309*b*, not shown in this view. A means for aligning and synchronizing both pulleys of the range of motion selector and resistance engagement mechanism 350 is provided by a solid steel bar 310 rigidly attached and fixed to the resistance mechanism frame 301. A means for connecting AC electric power to the device is provided by and electrical inlet at 311.

Figure 18:
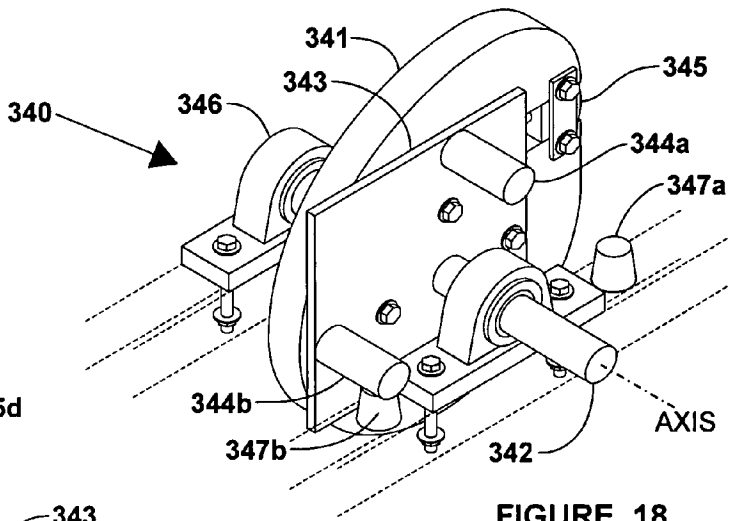
FIG. 18 is an isometric view of the cam and camshaft assembly of the resistance mechanism of the present invention.

Referring to FIG. 18, camshaft and cam assembly, generally indicated at 340, of the resistance mechanism, generally indicated at 300, of the present invention is shown in an isometric view. Camshaft 342 and plate 343 and cam 341 are rigidly connected. Each end of camshaft 342 is journalled in pillow block bearings 346 which are rigidly attached and fixed to the resistance mechanism frame 301. Preferred bearings have an extended inner race with dual set screws. Range of motion limit/stop bumpers 347*a* and 347*b* are also mounted on resistance mechanism frame 301. Range of motion limit/stop members 344*a* and 344*b* are mounted on plate 343 and determine and limit movement of the movement arm assembly. See FIG. 14. The protruding end of the camshaft 342 is machined and has threaded apertures to allow rigid and secure connection to the shaft collar 206 of the movement arm assembly. See FIG. 12. Camshaft and cam assembly 340 are shown at the flexed position or zero degrees of extension.

Figure 18A:
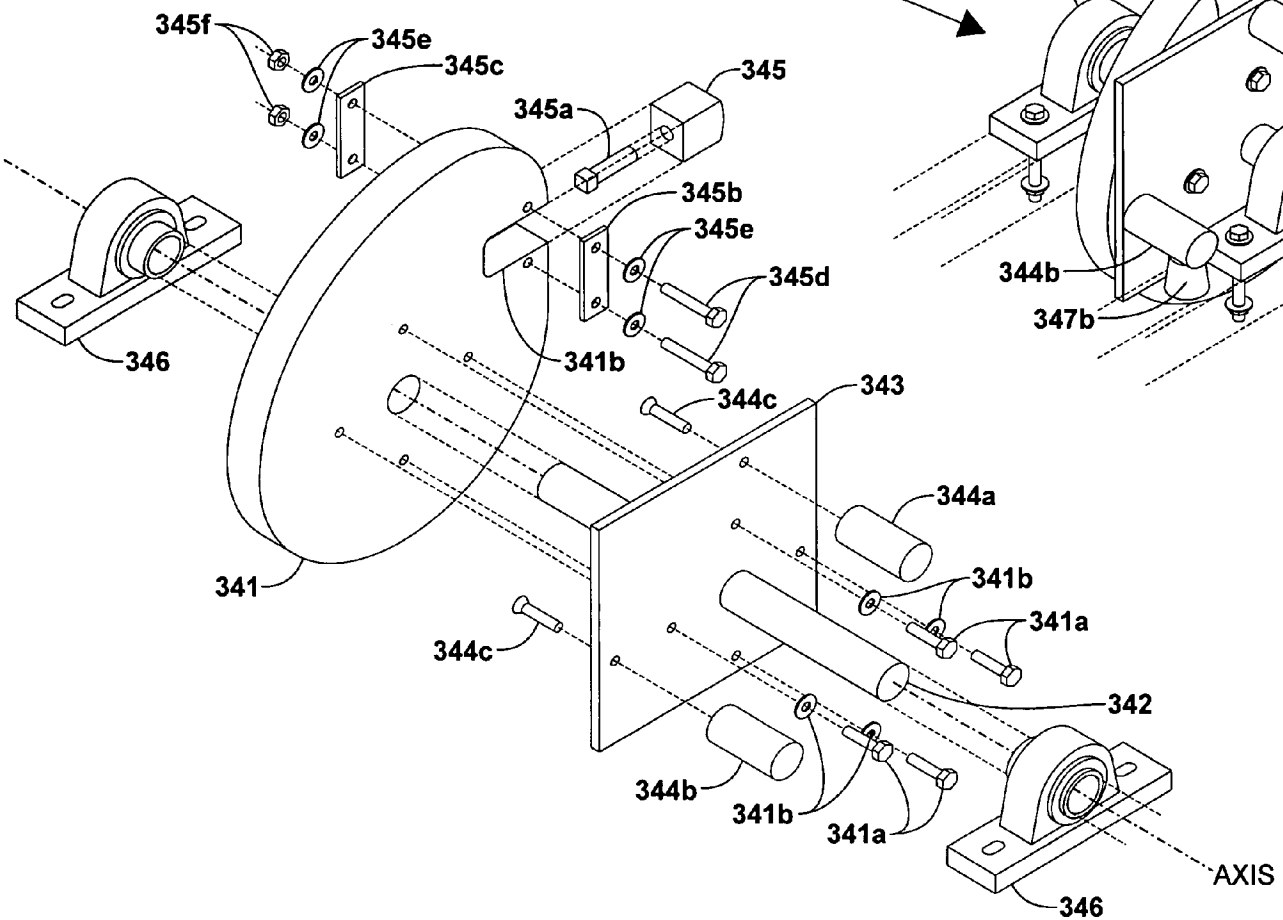
FIG. 18A is an exploded view of the cam and camshaft assembly of the resistance mechanism of the present invention.

Referring to FIG. 18A, camshaft and cam assembly, generally indicated at 340, of the resistance mechanism, generally indicated at 300, of the present invention is shown in an exploded view. A camshaft 342 is rigidly attached and fixed to a plate 343. Plate 343 has apertures which allow range of motion limit/stop members 344*a* and 344*b* to be rigidly attached and fixed from the reverse side by means of flush mount screws/bolts 344*c*. Plate 343 also has equally spaced apertures concentrically aligned around camshaft 342. Through apertures in plate 343, cam 341 is rigidly connected and fixed with bolts 341*a* and washers 341*b* into threaded apertures in cam 341 matching those in plate 343. A notch 341*b* is machined into the cam edge to allow the placement of a tension adjuster 345 for the belt 321 which connects to the range of motion selector and resistance engagement mechanism, generally indicated at 350. Tension adjuster comprises a block 345 threaded to receive an adjustment screw 345*a*. Block 345 is held in place by side plates 345*b* and 345*c*. Plates 345*b* and 345*c* are securely attached and fixed to cam 341 by means of bolts 345*d* washers 345*e* and nuts 345*f* through apertures in cam 341. Turning screw 345*a* in or out can adjust the tension on belt 321, not shown. Preferred material for camshaft 342 and plate 343 is stainless steel. Preferred material for cam 341 and adjuster block 345 is a strong, rigid plastic such as PVC or NYLATRON. The cam has a specific ratio of 1.4:1 to provide a continuous perceived resistance through the entire range of motion of the exerciser/subject. The axis of rotation of the cam should be on the AXIS to maintain constant synchronization with the movement arm regardless of the range of motion selected or performed.

Figure 19:
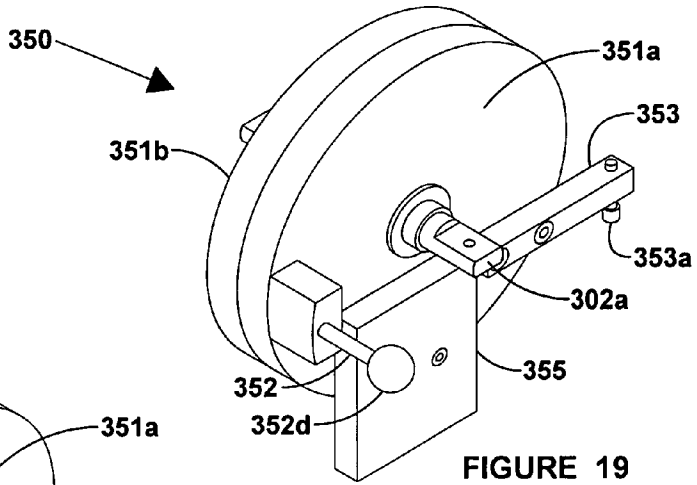
FIG. 19 is an isometric view of range of motion selector and resistance engagement assembly of the resistance mechanism of the present invention.

Referring now to FIG. 19, the range of motion selector and resistance engagement mechanism, generally indicated at 350, of the resistance mechanism, generally indicated at 300, of the present invention is shown in an isometric view. The desired or appropriate range of motion is selected and the resistance is engaged by means of a selector and engagement pin 352 and knob 352*d* rigidly and operatively connected to the engagement pulley 351*a*. The engagement pulley 351*a* and selector pulley 351*b* are each mounted on pairs of bearings, not shown in this view, which are journalled on shaft 302*a*. Both the engagement pulley 351*a* and selector pulley 351*b* are 10 inches in diameter and bearing mounted and free wheeling until they are engaged or connected by means of the selector/engagement pin 352. Appropriate position of engagement pulley 351*a* and tension on belt 321 connected to cam 341, is achieved by a counterweight 355 rigidly connected and fixed to engagement pulley 351*a*. Proper alignment between the engagement pulley 351*b* and the selector pulley 351*b* is achieved by means of alignment bars 353 and 354, not shown in this view, which have an adjustment screw 353*a* with lock/jam nut 353*b*. Proper alignment and adjustment of these components are essential to the smooth, efficient operation and use of this mechanism.

Figure 19A:
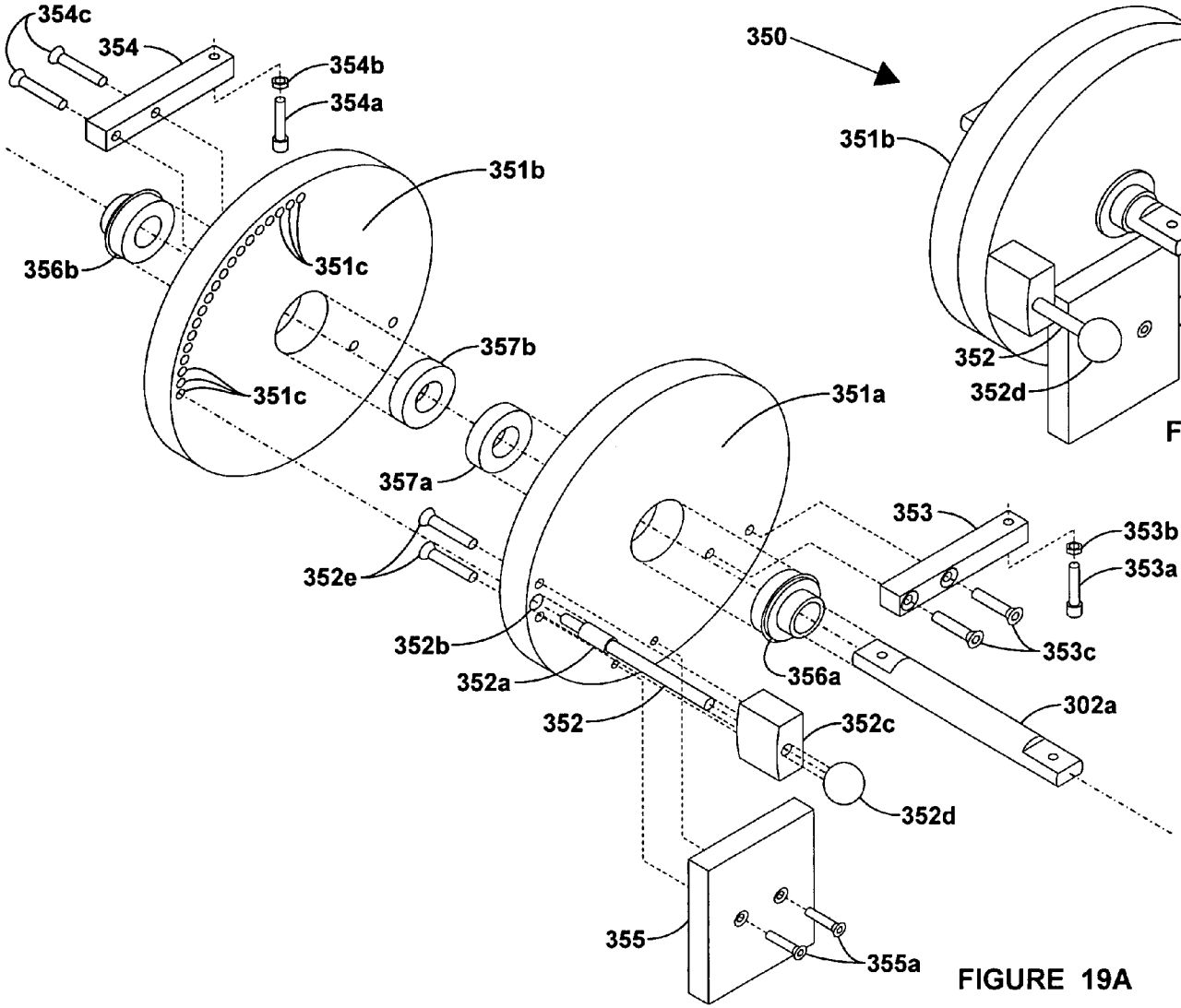
FIG. 19A is an exploded view of the range of motion selector and resistance engagement assembly of the resistance mechanism of the present invention.

Referring now to FIG. 19A, the range of motion selector and resistance engagement mechanism, generally indicated at 350, of the resistance mechanism, generally indicated at 300, of the present invention is shown in an exploded view. The engagement pulley 351 is machined to receive a pair of insert bearings 356*a* and 357*a*. The outside bearing 356*a* has and extended inner race and dual set screws and a snap ring. The engagement pulley 351*a* is machined to accept the selector/engagement pin 352. Large diameter pin lug/hub 352*a* is housed in an aperture in housing block 352*c* and an aperture 352*b* in the engagement pulley 351*a*. The selector pin 352 and selector pin housing block 352*c* are rigidly connected to the engagement pulley 351*a* by two flush mount bolts 352*e*. A knob 352*d* is attached to the threaded end of the selector/engagement pin. The selector/engagement pin 352 moves freely and efficiently in the housing block 352*c* and the matched aperture 352*b* in the engagement pulley 351*a*. Preferred material for the selector/engagement pin is stainless steel. Proper position and alignment are achieved by an alignment bar 353 which is rigidly attached and fixed to engagement pulley 351*a* by two bolts 353*c*. Precise adjustment and alignment are achieved by adjusting a bolt 353*a* and locking it in position with a lock/jam nut 353*b*. Proper position and tension of the connecting belt 321 is achieved by the placement of a counterweight 355 on the lower portion of engagement pulley 351*a* by two bolts 355*a*. The selector pulley 351*b* is machined to receive a pair of insert bearings 357*b* and 356*b*. The outside bearing 356*b* has an extended inner race with dual set screws and a snap ring. The selector pulley 351*b* is machined with apertures 351*c* to receive the end of the selector/engagement pin 352. The apertures 351*c* are spaced and positioned in four degree increments and allow range of motion selection from zero "0" to eighty-four degrees. Proper position and alignment with the engagement pulley 351*a* and selector/engagement pin 352 is achieved by an alignment bar 354 which is rigidly attached and fixed to the selector pulley by two bolts 354*c*. Precise adjustment and alignment are achieved by adjusting bolt 354*a* and lock/jam nut 354*b*. Preferred material for engagement pulley 351*a* and selector pulley 351*b* is a strong, rigid plastic such as PVC or NYLATRON.

Figures 20, 20A:
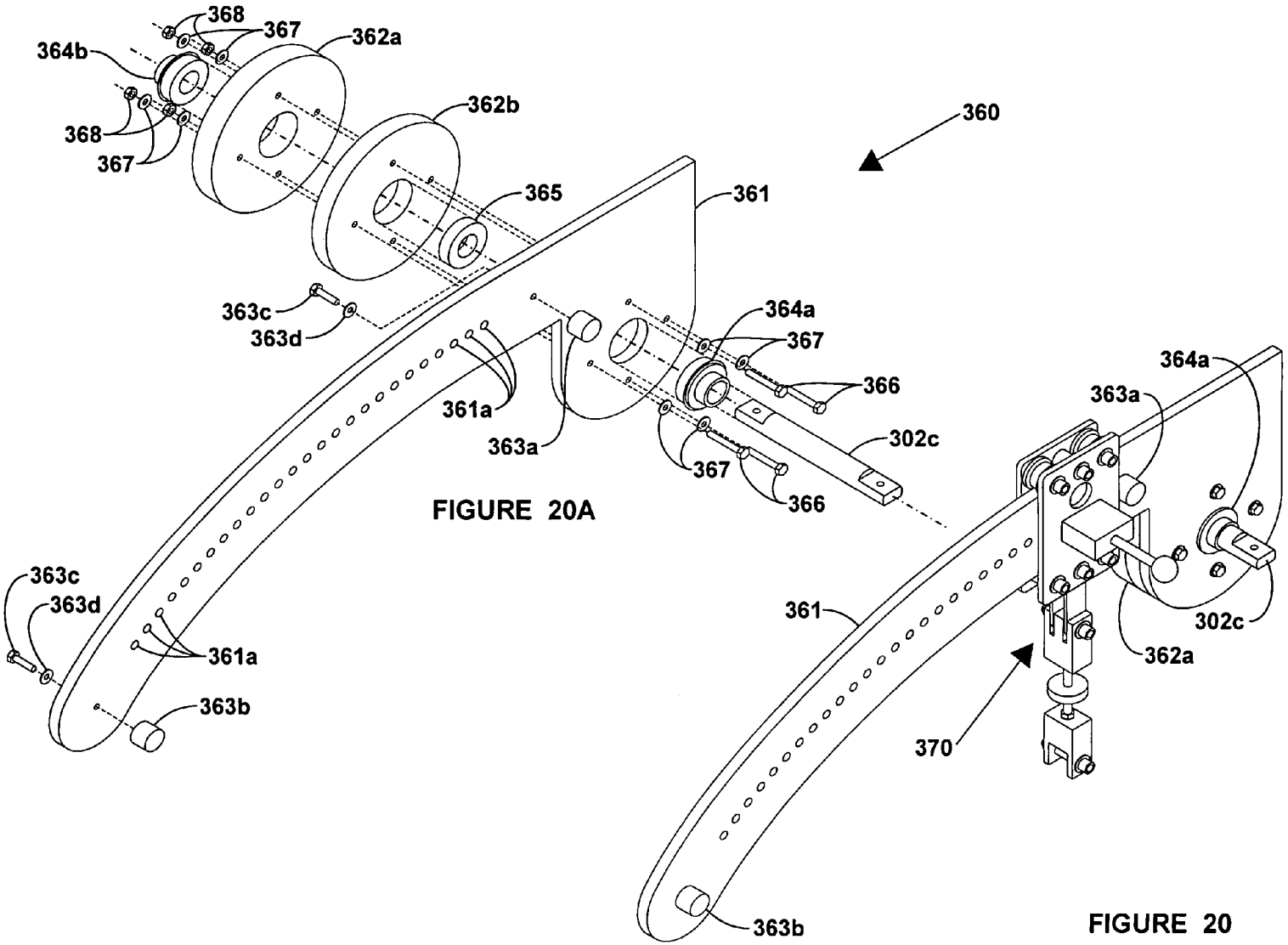
FIG. 20 is an isometric view of the variable resistance assembly of the resistance mechanism of the present invention.
FIG. 20A is an exploded view of the variable resistance assembly of the resistance mechanism of the present invention.

Referring now to FIG. 20, the resistance arc/lever assembly, generally indicated at 360, of the resistance mechanism, generally indicated at 300, of the present invention is shown in an isometric view. A suitably broad range of resistance levels is provided by means of an arc/lever 361 properly positioned and configured to provide variable resistance from a low level at the far end, farthest from shaft 302*c*, of the arc/lever to a much higher level at the closest end of the arc lever. The shape and dimension of the arc/lever 361 is determined by the radius point found somewhere near the front middle edge of the small pulley 303*a* mounted in the lower portion of the resistance mechanism 300, see FIG. 17. The resistance selector mechanism, generally indicated at 370, can operatively connect to the resistance arc/lever 361 by means of 26 equally spaced and positioned apertures 361*a*. The resistance selector mechanism is shown in and explained detail in FIGS. 21 and 21A. In essence, the resistance mechanism 300 is selectively activated and operated by either a long or short lever. The configuration and operation of the resistance arc/lever 360 and resistance selector mechanism 370 are shown and explained in FIG. 22. The resistance selector mechanism travel limits are determined by stops 363*a* and 363*b* mounted at either end of the aperture pattern 361*a* on the arc/lever 361. The arc/lever 361 and pulley 362*a* and spacer 362*b*, not shown in this view, are mounted on bearings, not shown in this view, which are journalled on shaft 302*c*.

Referring now to FIG. 20A, the resistance arc/lever assembly, generally indicated at 360, of the resistance mechanism of the present invention is shown in an exploded view. Arc/lever 361 is machined to receive an insert bearing 364*a* with an extended inner race with dual set screws and a snap ring. The arc/lever 361 is also machined with 26 equally spaced apertures 361*a* to accept the end of resistance selector pin 372, see FIG. 21A. Resistance selector mechanism stops 363*a* and 363*b* are rigidly attached and fixed to arc/lever 361 by bolts 363*c* and washers 363*d*. Preferred material for arc/lever is solid 0.50" plate aluminum. Spacer 362*b* is machined to receive an insert bearing 365. Pulley 362*a* is machined to receive an insert bearing 364*b* with an extended inner race with dual set screws and a snap ring. Preferred material for pulley 362*a* and spacer 362*b* is a strong, rigid plastic such as PVC or NYLATRON. Arc/lever 361 and spacer 362*b* and pulley 362*a* are rigidly and concentrically connected through matching apertures by bolts 366 and washers 367 and nuts 368. Arc/lever 361 and spacer 362*b* and pulley 362*a* are mounted on bearings journalled on shaft 302*c*.

Figure 21:
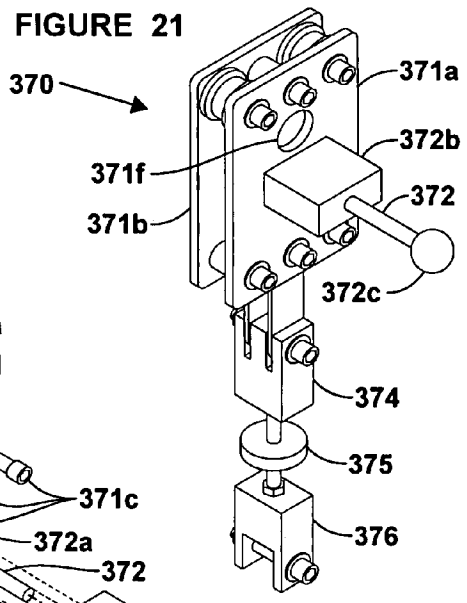
FIG. 21 is an isometric view of the resistance selector assembly of the resistance mechanism of the present invention.

Referring now to FIG. 21, the resistance selector mechanism, generally indicated at 370, is shown in an isometric view. The resistance selector mechanism 370 can smoothly and accurately traverse the arc portion of the arc/lever 361 and select and operatively connect to any of the twenty-six apertures 361*a* and thus establish a lever which activates the resistance mechanism 300. The length of the lever determines the dynamics and effective resistance encountered when force is applied through the movement arm 200 by the subject/exerciser. The resistance selector mechanism comprises two plates 371*a* and 371*b* and contain rollers and spacers, not shown in this view, which maintain proper and accurate alignment of mechanism and selector pin 372 and arc/lever apertures 361*a*, see FIG. 20A. The selected resistance level is shown through a "sight hole", aperture 371*f*, which reveals the alphabetical designation A-Z, see FIG. 22. The actual force of the resistance is carried/handled by two radial bearings 379, housed in the resistance selector mechanism, see FIG. 21A. The selector pin 372 only maintains selection and position. The resistance selector mechanism 370 is connected to the lower pulley 303*b*, see FIG. 22, by a belt 313. Proper tension and adjustment of this portion of the resistance mechanism 300, is achieved by means of an adjustment member 375 with left/right threads. This adjustment member 375 operatively connects to blocks 374 and 376. Proper adjustment and position are achieved and maintained with lock/jam nuts, see FIG. 21A.

Figure 21A:
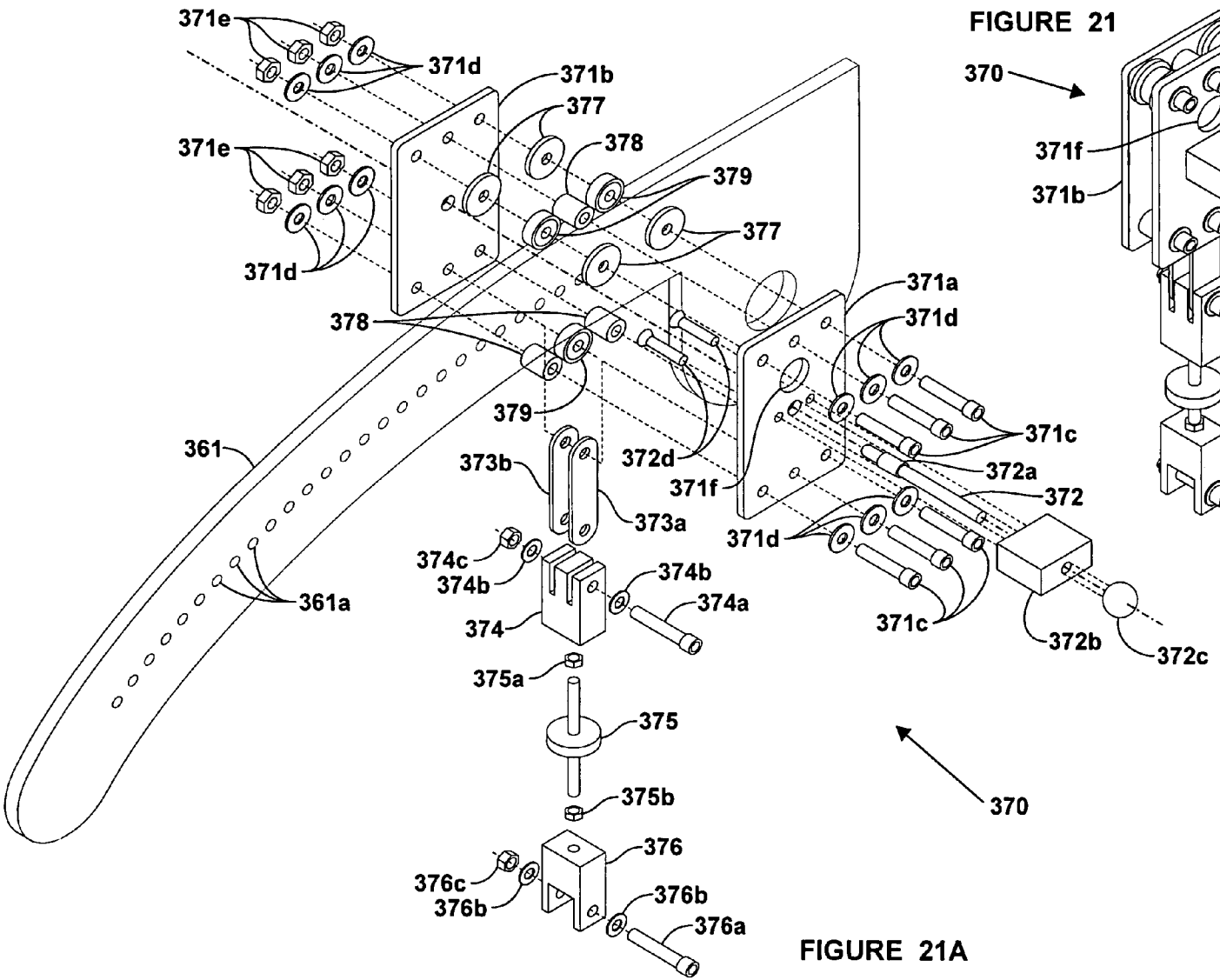
FIG. 21A is an exploded view of the resistance selector assembly of the resistance mechanism of the present invention.

Referring now to FIG. 21A, the resistance selector mechanism, generally indicated at 370, of the present invention is shown in an exploded view. Plates 371*a* and 371*b* are machined to allow the placement of radial bearings 379 and guide spacers 377 and spacers 378 and hanger straps 373*a* and 373*b* to be assembled in such a manner as to provide a rigid unit which allows smooth and positive movement along the arc portion of the arc/lever 361. The top two radial bearings 379 provide smooth travel and also to support and handle the force exerted by the subject/exerciser and movement arm assembly 200. The lower radial bearing 379, acts to maintain proper position, alignment and allow free and smooth travel by the resistance selector mechanism 370 on the machined upper and lower surfaces of the arc/lever 361. The front plate 371*a* is machined to allow mounting of a housing block 372*b* which houses and supports the selector pin 372. The selector pin 372 is machined on one end to allow insertion into size matched apertures 361*a* on the arc/lever 361. The other end of the selector pin 372 is machined to connect selector knob 372*c*. A shoulder section 372*a* of the selector pin 372 travels in size matched apertures in housing block 372*b* and plate 371*a*. Housing block 372*b* is rigidly connected to plate 371*a* by means of two flush mount bolts 372*d* through apertures in plate 371*a*. Plates 371*a* and 371*b*, bearings 379, guide spacers 377, spacers 378 and hanger straps 373*a* and 373*b* are rigidly and operatively connected by means of bolts 371*c*, washers 371*d* and nuts 371*e*. Suspended from the other end of hangers straps 373*a* and 373*b* are the connection and adjustment components of the resistance selector mechanism 370. The upper adjustment block 374 is machined to accept one end of the adjustment member 375 which has left/right threads to allow easy tension adjustment of connecting belt 313, see FIG. 22. The lower adjustment block 376 is machined to accept the other end of adjustment member 375. The proper adjustment and/or tension of the mechanism 370 is maintained by means of lock/jam nuts 375*a* and 375*b*. The upper adjustment block 374 is operatively connected to the hanger straps by means of a bolt 374*a*, washers 374*b* and a nut 374*c*. The lower adjustment block 376 is operatively connected to belt 313 by means of a bolt 376*a*, washers 376*b* and a nut 376*c*. Preferred material for the plates 371*a* and 371*b* and housing block 372*b* and adjustment blocks 374 and 376 is aluminum. Preferred material for selector pin 372 and hanger straps 373*a* and 373*b* is stainless steel. Preferred material for guide spacers 377 and spacers 378 is NYLATRON.

Figure 22:
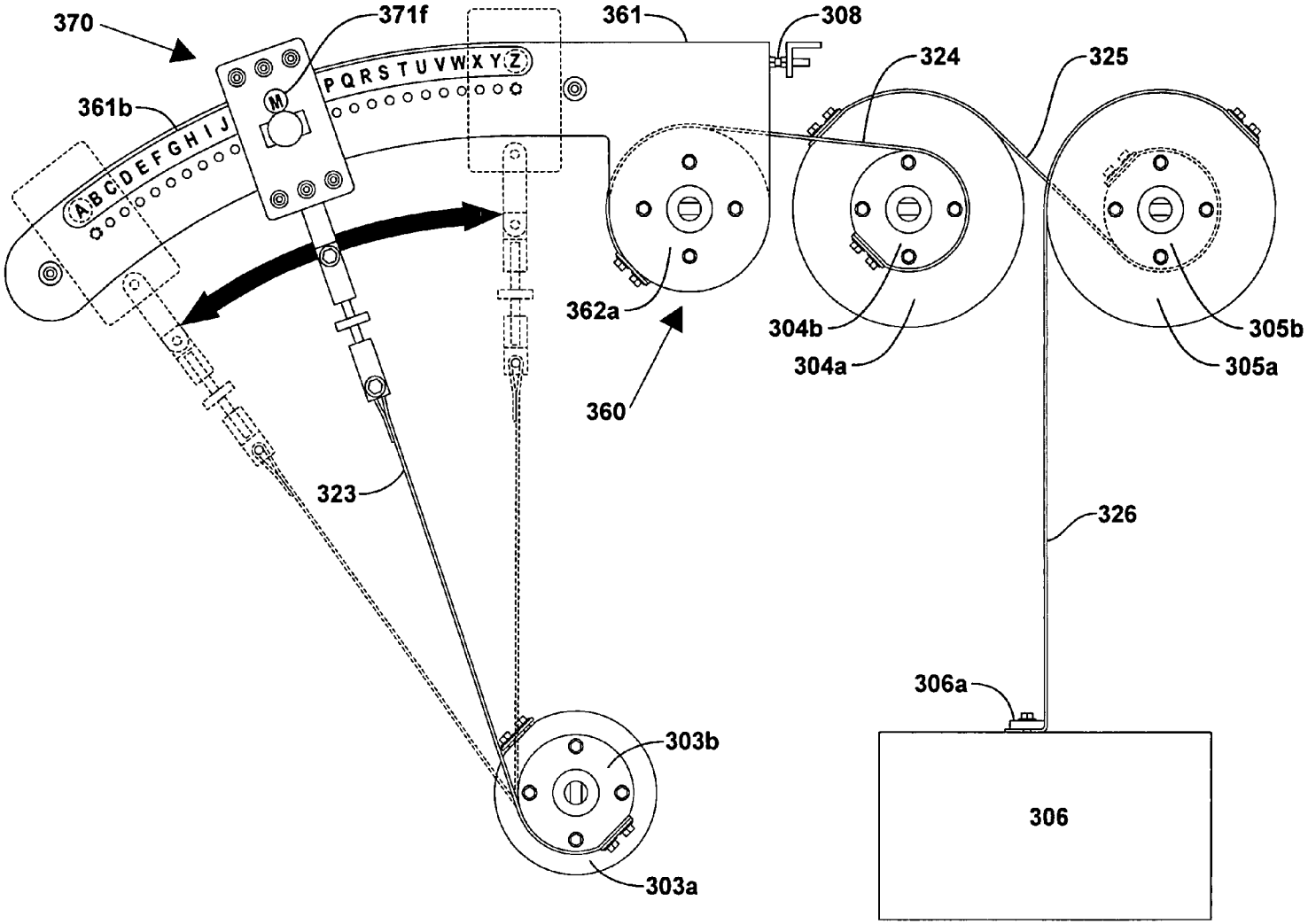
FIG. 22 is a side view of the variable resistance assembly of the resistance mechanism of the present invention showing operational range, configuration, relative theory and function.

Referring now to FIG. 22, the resistance selector mechanism, generally indicated at 370 and the arc/lever assembly, generally indicated at 360, of the present invention are shown in a side view. The amount of resistance provided by the resistance mechanism 300 of this device is determined primarily by the length of the lever used to lift the dead weight 306. The arc/lever 361, which acts as a lever arm, is rigidly connected to pulley 362*a* and by belt 324 to the small pulley 304*b* which is rigidly and concentrically connected to pulley 304*a* and by belt 325 to the small pulley 305*b* which is rigidly and concentrically connected to pulley 305*a* and by belt 326 to dead weight 306. In effect, the arc/lever 361 is connected to the dead weight 306. However, by virtue of the physics involved the effective weight or value of the dead weight has been increased considerably. The basic theory of lever and fulcrum dictate that the effective weight or resistance which exists at the arc/lever 361 is significantly greater than the actual weight or resistance inherent in the dead weight 306. When assembled and adjusted, the arc/lever 361 is "loaded" by means of the dead weight being suspended slightly above the base frame. The precise position is determined and maintained by means of an adjusting bolt 308 with lock/jam nut which is fixed to a frame member, angle, of resistance mechanism frame 301. This allows for a more consistent and immediate response to motion or movement generated by the subject/exerciser through the movement arm assembly, generally indicated at 200, not shown in this view. Proper "loading" of the dead weight is achieved by means of the connection of belt 326 to the dead weight 306 which occurs at connector strap/clamp 306*a*. The effective length of the lever used to engage the resistance is determined and selected by the resistance selector mechanism, generally indicated at 370. Any one of twenty-six available positions, lengths, may be selected. The selected position is displayed in the "sight hole" aperture 371*f*. An A-Z decal/label 361*b* is affixed to the arc/lever 361. KEVLAR is the preferred material for the belts in this device. There is little, if any, perceptible give or stretch in this material. Once properly assembled and the system is "loaded" and the belts have seated, there will be little, if any, need for future adjustment.

Referring now to FIG. 23, the typical design and construction of the various pulleys, spacers and components used in this device of the present invention are shown in this view. Also shown are the typical attachment/connection means used in this device. Pulley 331 represents typical center aperture 331*a* machined to accept insert bearings, not shown. Bearings are press-fit into aperture which allows grouping various size pulleys together on the same shaft, not shown. Concentrically and equally spaced around the center aperture are four smaller apertures 331*b* which allow bolts, washers and nuts, not shown, to be used to group various size pulleys together as a unit. The size and pattern of the center aperture 331*a* and the four smaller apertures is the same and typical for all pulleys, spacers and components of this device unless otherwise indicated. Most pulleys, indicated typically as 331, have a flat surface 331*c* machined on one quadrant which is offset forty-five (45) degrees from the alignment of the four small apertures 331*b*. The flat surface area 331*c* is machined with threaded apertures 331*d*, to accept two bolts 333. There is a metal belt/strap clamp 332 with apertures which match the spacing of the threaded apertures 331*d* of the flat surface 331*c*. Matching apertures are punched in the ends, where indicated, of the various KEVLAR belts used in the device of the present invention. Bolts 333 and washers 334 pass through the belt/strap clamp 332 and the various belts, indicated as 320, and are suitably threaded into the threaded apertures 331*d*. Suitable force, torque, is applied to firmly and securely attach belts 320 to the various pulleys indicated as 331. Various size pulleys, spacers and components are assembled and utilized in various combinations and configurations in the device of the present invention.

Figure 24:
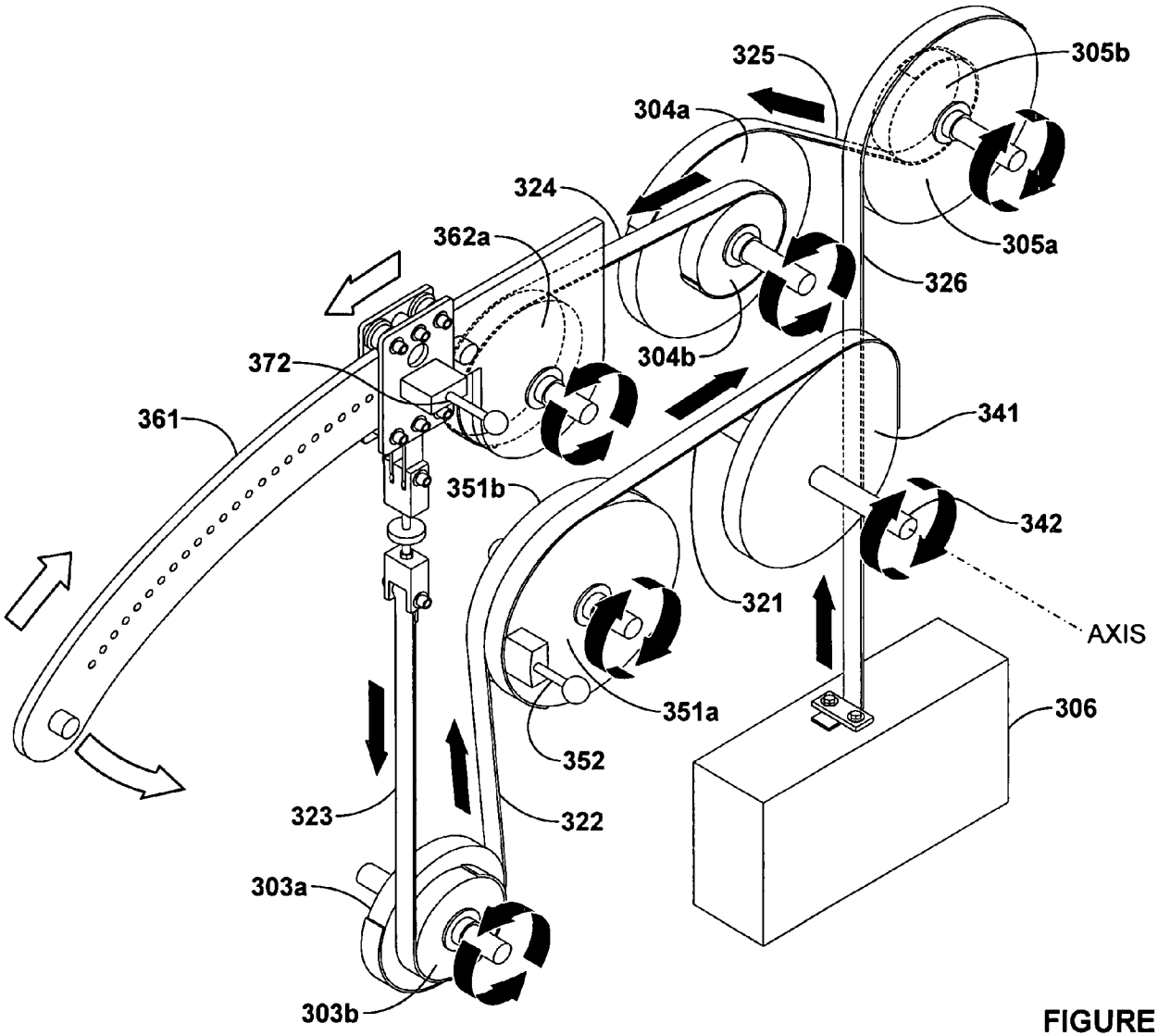
FIG. 24 is an isometric view of the resistance mechanism of the present invention showing typical action, cycle and sequence of the resistance mechanism during use and operation.

Referring now to FIG. 24, the typical operational action, cycle and sequence of the resistance mechanism, generally indicated at 300, of the present invention is shown/illustrated in an isometric view with arrows to indicate motion and direction. Movement (action, motion, force) is introduced into the resistance mechanism 300 through the camshaft 342, which is operatively connected to the movement arm assembly 200, not shown in this view. All movement inside the resistance mechanism 300 is conditioned by the cam 341. The cam 341 is rigidly connected to the camshaft 342 which is rigidly and operatively connected to the movement arm assembly 200. The placement and position of the cam 341 is critical in that it always (constantly) maintains proper relationship and synchronization with the movement arm assembly 200 regardless of movement arm position throughout the range of motion. This cam is designed to accommodate the differences in the established strength levels inherent in the lumbar musculoskeletal system from the flexed position, zero degrees of extension, to the extended position which might be as much as 75 degrees or more. An important factor in the design and use of the cam is that it "flattens" or levels the perceived level of resistance experienced by the subject/exerciser throughout the performed range of motion. By positioning the cam at this input point, ahead of the actual resistance, all movement and resistance are properly timed or synchronized regardless of movement arm position. The range of motion available in the device of the present invention is eight-five (85) degrees. Range of motion stops or limits, not shown in this view, are placed at approximately zero and eighty-five degrees. As the camshaft and cam assembly 340, see FIGS. 18 and 18A, rotates in a clockwise motion, an operatively connected belt 321, which is operatively connected to the engagement pulley 351*a* of the range of motion selector and resistance engagement mechanism 350, see FIGS. 19 and 19A, said belt pulls the engagement pulley 351*a* in a clockwise motion. The movement arm assembly 200 and the camshaft and cam assembly 340 and the engagement pulley 351*a* are all operatively connected and allowed to "freewheel" and provide little or no resistance to movement when not engaged or connected by means of the selector and engagement pin 352 to the selector pulley 351*b*. When the selector pulley 351*b* is engaged and connected by means of the selector and engagement pin 352, the selector and engagement mechanism 350 also turns in a clockwise motion when movement is initiated by the subject/exerciser by means of the movement arm assembly 200, not shown in this view. As the selector pulley 351*b* rotates in a clockwise motion, an operatively connected belt 322, which is operatively connected to a lower pulley 303*a*, said belt is connected in such a manner to produce a counter-clockwise motion. Pulley 303*a* is rigidly and concentrically connected to a smaller pulley 303*b*, see FIG. 17. As pulley 303*b* rotates in a counter-clockwise motion, an operatively connected belt 323, which is operatively connected to the resistance selector mechanism 370, see FIGS. 21 and 21A is pulled downward. The resistance selector mechanism 370 allows selection of any one of twenty-six levels of resistance available by means of 26 apertures in the arc/lever 361 of the arc lever assembly 360, see FIGS. 20 and 20A. When the resistance selector mechanism 370 is engaged and connected at the appropriate resistance level by means of the resistance selector pin 372 to the resistance arc/lever 361, said lever is pulled downward and rotates counterclockwise on its axis. The resistance arc/lever 361 is rigidly and concentrically connected to pulley 362*a*. As pulley 362*a* rotates in a counter-clockwise motion, an operatively connected belt 324, which is operatively connected to a small pulley 304*b*, said belt is connected in such a manner to produce a counter-clockwise motion. Pulley 304*b* is rigidly and concentrically connected to a larger pulley 304*a*, see FIG. 17. As pulley 304*a* rotates in a counter-clockwise motion, an operatively connected belt 325, which is operatively connected to a small pulley 305*b*, said belt is connected in such a manner to produce a clockwise motion. Pulley 305*b* is rigidly and concentrically connected to pulley 305*a*, see FIG. 17. As pulley 305*a* rotates in a clockwise motion, an operatively connected belt 326, which is securely connected to dead weight 306, said belt pulls upward, lifting weight which provides resistance to movement initiated by the subject/exerciser by means of the movement arm assembly 200.

An important aspect and consideration of any exercise machine design is the factor of inertia. A low or short travel distance of the resistance weight is desirable. Inertia results from speed and distance relative to the actual weight itself. Less weight moving at slower speeds and shorter distances develops less inertia. With the device of the present invention, different diameter pulleys are connected and share the same axis, in essence, they become a lever and a fulcrum. When used in series and carefully configured and connected they can act to multiply the weight or force factor inherent in the dead weight. Thus the actual weight of the machine itself and the weight actually moved during use and operation are decreased significantly while still maintaining an appropriate level of effective/perceived weight or resistance. The actual travel distances or movement by the various components of the resistance mechanism are also an important consideration. The amount of motion or movement input through the movement arm and the range of motion selected and the resistance level selected determine the actual motion or movement inside the resistance mechanism. As a result of this design, the greatest vertical travel distance of the dead weight which is produced by a full range movement of the movement arm is slightly less than nine inches. The greatest travel distance or movement occurs when the greatest resistance "Z" is selected at the position or aperture closet to the axis of rotation of the arc/lever. The least travel distance or movement of the dead weight is at the lowest resistance at the farthest position form the axis of rotation of the arc/lever. At the position of least resistance "A", a full range movement, eighty-five degrees, produces a vertical movement of the dead weight of less than four inches. Less weight, slower speed and shorter distance results in less unwanted inertia being developed during use and operation of the device of the present invention.

Figure 25:
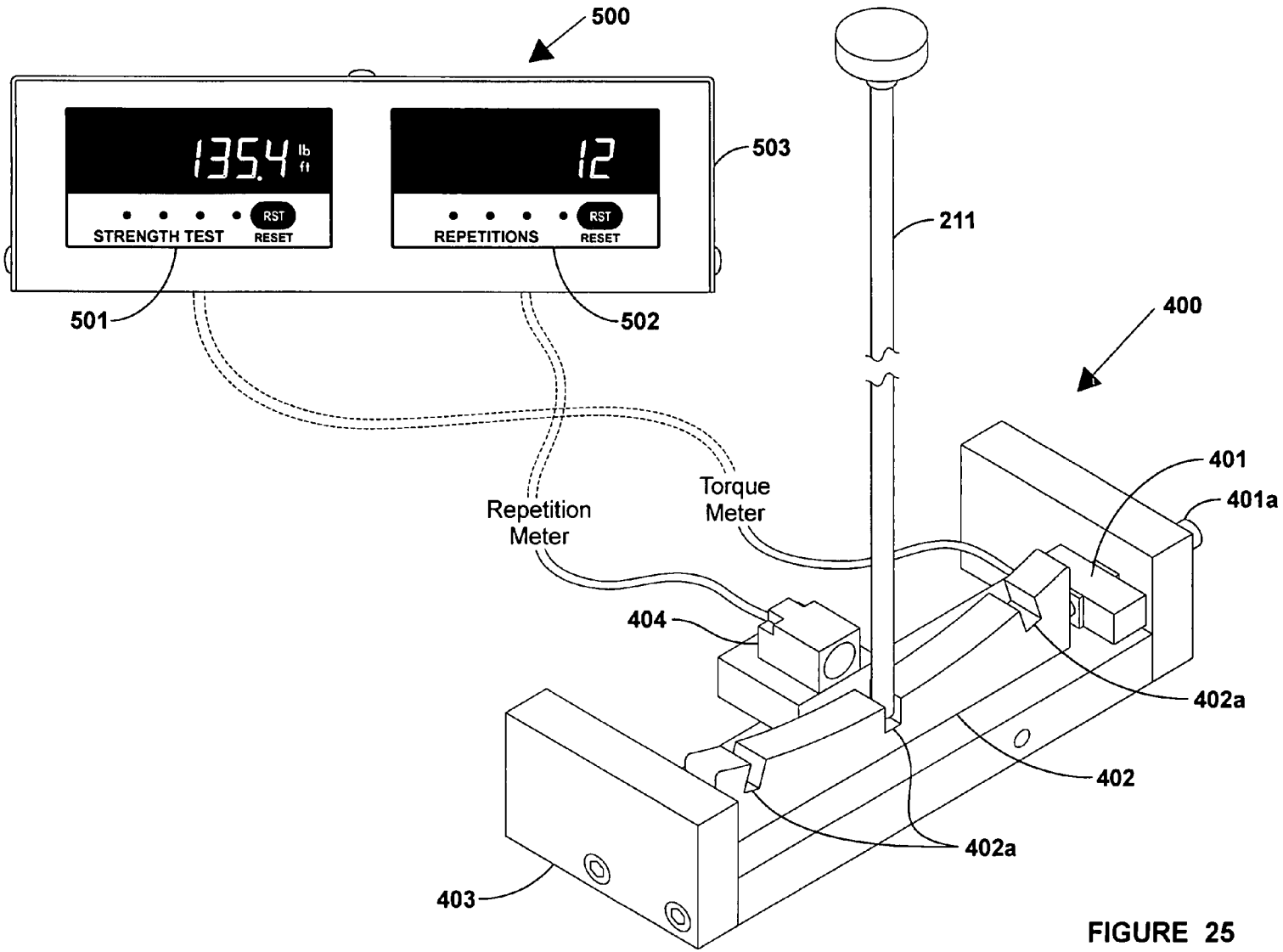
FIG. 25 is an isometric view of the load cell assembly, strength testing component, of the present invention.

Referring now to FIG. 25, the load cell assembly, generally indicated at 400, of the device of the present invention is shown is an isometric view. The frame support 403 for the load cell assembly 400 is machined from solid aluminum bar stock. The load cell 401 is rigidly connected to the frame support 403 by a bolt 401*a* and a lock/jam nut, not shown. Preferred load cell is an Interface Model SML-1000. The load cell 401 is operatively connected by a threaded shaft, not shown, to an arc member 402 which has three machined slots 402*a* which allow three different test positions. The machined bottom surface of arc member 402 sits on the horizontal member of the frame support 403. Preferred material for arc member is stainless steel. The load cell 401 is connected by potted cable to a meter, readout 501, generally indicated at 500 and mounted atop the resistance mechanism, generally indicated at 300. Preferred meter is a Red Lion—Model PAX S. The meter is programmed to retain peak torque registered during test procedures. Although the load cell 401 and meter 501 are capable of detecting very small increments of force or torque, the system is programmed to display force or torque in tenths of a foot pound. The movement arm assembly 200 can operatively connect or engage the arc member 402 by means of the test engagement shaft 211 of the test mode engagement mechanism 210, see FIGS. 15 and 15A. Also housed in the load cell assembly 400 is a proximity sensor 404. Preferred sensor is a Turck Model Q25-AP6X. In the exercise mode, the sensor 404 detects, displays and counts repetitions performed by the subject/exerciser. The sensor 404 is connected by potted cable to a meter, readout 502, generally indicated at 500. Preferred meter is a Red Lion—Model PAX C. Both meters can be quickly and easily reset to "zero" prior to any test or exercise session. Meters are housed in a formed stainless steel cabinet 503 assembled with tamper resistant screws.

Figure 26:
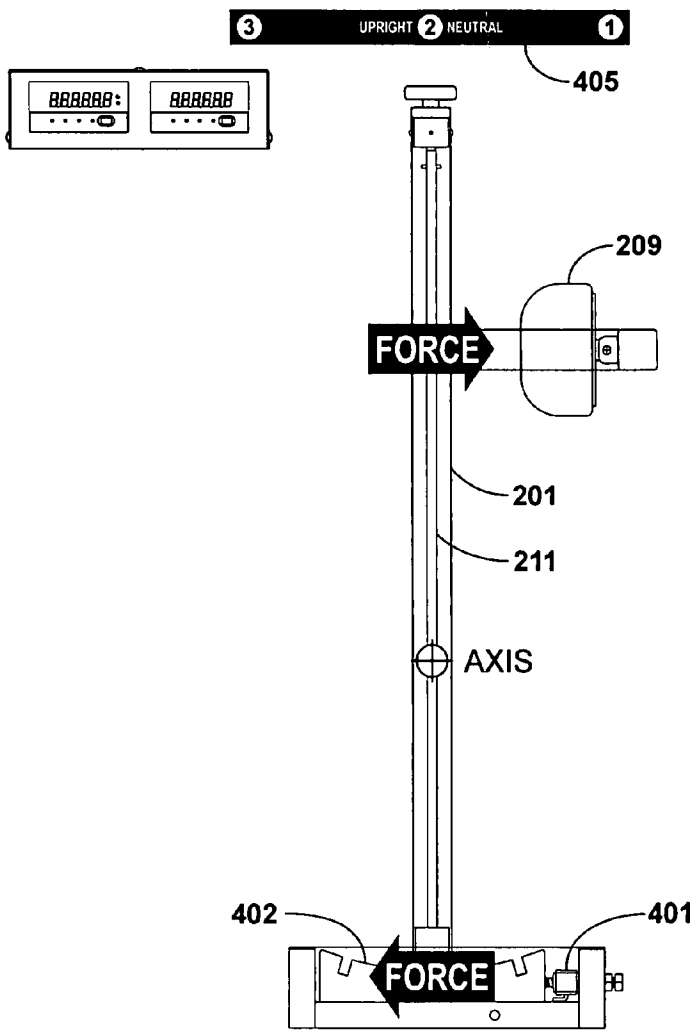
FIG. 26 is a side view of the load cell assembly of the present invention in the upright, test position showing components, configuration, relative theory and function.

Referring now to FIG. 26, the load cell test assembly, generally indicated at 400, of the device of the present invention is show in a side view. In the preferred configuration of the device of the present invention, the load cell test assembly 400 is positioned opposite and equally distant from the AXIS from the resistance pad 209 of the movement arm assembly 200. When engaged and operatively connected the device of the present invention allows for meaningful static testing of the subject's relative lumbar extension strength. In the test mode and at the selected test position, the subject is instructed to slowly build force by pushing their upper back against the resistance pad 209. The subject is instructed to slowly build to an honest, maximum exertion. Care should be taken and caution given to only expend or exert pain-free effort. Subject should avoid any quick, jerky motion or effort. Test effort should be developed and released in a slow, controlled manner. Relative test positions are indicated by a label/decal 405 affixed to the resistance mechanism frame. In many instances, subjects might be tested in only one position. When a one position only test is used, most often the test will be conducted at the middle, upright neutral position.

Figure 26A:
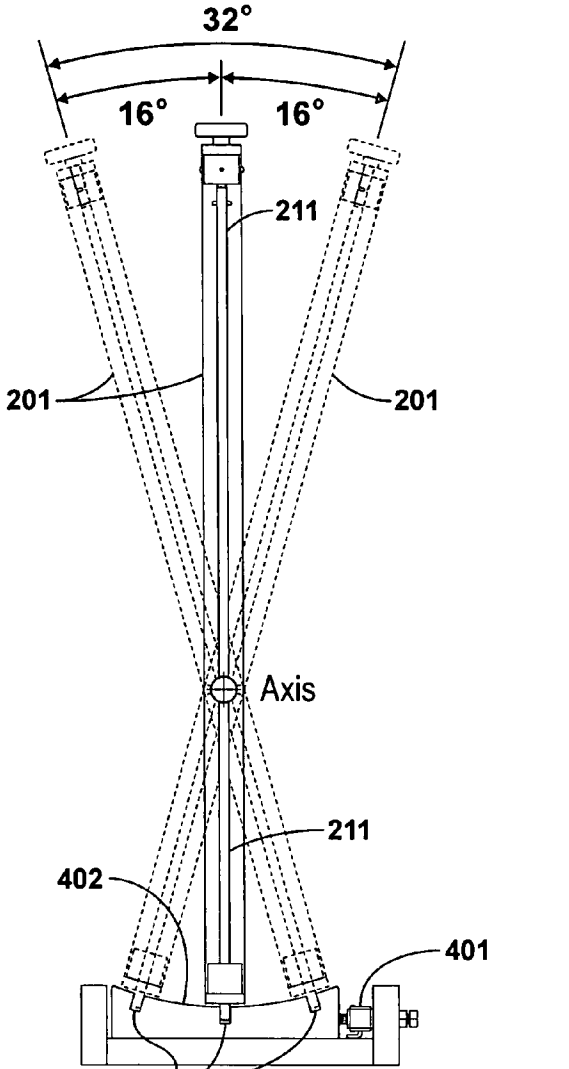
FIG. 26A is a side view of the load cell assembly of the present invention showing the engagement rod in three test positions.

Referring now to FIG. 26A, the load cell test assembly, generally indicated at 400, of the device of the present invention is shown in a side view. The movement arm assembly 200 can be maneuvered to any of three test positions. Each test position is separated by 16 degrees. To engage a test position, the movement arm 200 is maneuvered to the appropriate position and the engagement shaft 211 is lowered, pushed into the appropriate arc member slot 402*a*. Test engagement mechanism 210 has a position retainer system which maintains the test mode position or the exercise position, see FIGS. 15 and 15A.

The foregoing description of the invention has been directed to a particular preferred embodiment of the present invention for the purposes of explanation and illustration. It will be apparent to those skilled in the art that many modifications and changes in the apparatus may be made without departing from the scope and spirit of the invention. It is therefore intended that the following claims cover all equivalent modifications and variations as fall within the scope of the invention as defined by the claims.

The invention claimed is:

1. A lumbar extension machine comprising:

(a) a seat assembly having a height adjustable seat adjustably secured to said seat assembly and a pelvic restraint pad fixedly secured to said seat assembly;

(b) a movement arm assembly rotatably secured to said seat assembly, said movement arm assembly having an axis of rotation;

(c) a variable resistance mechanism connected to said movement arm assembly through said axis of rotation;

(d) said height adjustable seat being adjustable adjacent to and in relation to said pelvic restraint pad; and (e) a load cell module statically securable to said movement arm assembly through its axis of rotation.

2. The Lumbar extension machine according to claim 1 further comprising a pair of handlebars extending from the movement arm assembly to allow and provide movement arm control and consistent arm and upper body positioning.

3. The lumbar extension machine according to claim 1 wherein said seat assembly further comprises:

(a) a seat hingedly secured at the front to a frame;

(b) a pair of rotating cams rigidly connected by a rod and mounted underneath and transverse said seat adjacent said pelvic restraint pad such that when said rod is rotated the cams move the rear of said seat upward or downward;

(c) a height adjustable foot rest secured to said frame;

(d) a pair of adjustable shin pads secured to said frame; and (e) a screw driven mechanism attached to said pair of adjustable shin pads to apply restraint force.

4. The lumbar extension machine according to claim 1 wherein said load cell module comprises an arcuate member rigidly connected to a load cell and an engagement rod mounted through said seat assembly, said arcuate member having engagement slots for engagement with said engagement shaft to statically secure said rotatable upright member to said load cell.

5. A lumbar extension machine comprising:

(a) a seat assembly having a height adjustable seat and a pelvic restraint pad secured thereto;

(b) a movement arm assembly rotatably secured to said seat assembly, said movement arm assembly having an axis of rotation;

(c) a variable resistance mechanism connected to said movement arm assembly through said axis of rotation, said variable resistance module comprising a free weight attached to an adjustable length lever arm by a series of pulleys and pulley belts, one of said pulleys being rigidly attached to said movement arm assembly through its axis of rotation;

(d) said height adjustable seat being adjustable adjacent said pelvic restraint pad; and said pulley being rigidly attached to said movement arm assembly comprises a 1.4:1 cam.

6. The lumbar extension machine according to claim 5 further comprising a combination range of motion adjustment/resistance engagement mechanism.

7. The lumbar extension machine according to claim 6 wherein said combination range of motion adjustment/resistance engagement mechanism comprises (a) a first pulley connected to said 1.4:1 cam by a first belt;

(b) a second pulley coaxially mounted adjacent to said first pulley and connected to the remainder of said series of pulleys and belts, said second pulley having a plurality of apertures near its outer circumference; and (c) an engagement selector pin engageable through said first pulley into one of the plurality of apertures to lock the pulley together and allow a selected range of motion about the axis of rotation.

8. The lumbar extension machine according to claim 6 wherein the resistance is adjusted by a resistance selector mechanism comprising:

(a) an arcuate resistance selector arm having a pulley rigidly connected at one end to provide an axis of rotation, said pulley being connected to said free weight by at least one pulley belt; and (c) a resistance selector moveable on and along said arcuate resistance arm and connected to said 1.4:1 cam by at least one pulley and belt.

9. The lumbar extension machine according to claim 1 further comprising a proximity sensor module mounted adjacent said movement arm assembly to detect the passage of the movement arm and count the number of repetitions of movement.

10. A lumbar extension machine comprising:

(a) a seat assembly comprising;

(i) a seat frame (ii) a seat hingedly secured at the front to said seat frame;

(iii) a pelvic restraint pad secured to said seat assembly;

(iv) a pair of rotating cams rigidly connected by a rod and mounted underneath and transverse said seat adjacent said pelvic restraint pad such that when said rod is rotated the cams move the rear of said seat upward or downward;

(b) a movement arm assembly rotatably secured to said seat assembly, said movement arm assembly having an axis of rotation (c) a variable resistance mechanism securable to said movement arm assembly through its axis of rotation, said variable resistance module comprising a free weight attached to an adjustable length lever arm by a series of pulleys and pulley belts one of said pulleys being rigidly attached to said rotatable back member through its axis of rotation;

(c) a load cell module statically securable to said movement arm assembly through its axis of rotation;

(d) a pair of handlebars extending from the upper end of said movement arm assembly;

(e) an adjustable lower body restraint system mounted on said seat assembly comprising;

(i) a height adjustable foot rest connected to said seat frame, and (ii) a pair of adjustable shin pad restraints connected to said seat frame;

(f) a pivoting resistance pad at the upper end of said movement arm assembly; and (g) a pelvic restraint pad secured on said back member near said seat.

11. The lumbar extension machine according to claim 10 wherein said load cell module comprises an arcuate member rigidly connected to a load cell and an engagement shaft mounted through said seat assembly, said arcuate member having engagement slots for engagement with said engagement shaft to statically secure said movement arm assembly to said load cell.

* * * * *